US012344918B2

(12) United States Patent
Mantione et al.

(10) Patent No.: US 12,344,918 B2
(45) Date of Patent: Jul. 1, 2025

(54) TITANIUM ALLOYS

(71) Applicant: ATI Properties LLC, Albany, OR (US)

(72) Inventors: John V. Mantione, Indian Trail, NC (US); David A. Brice, Marshville, NC (US); LaShonda Cozort, Monroe, NC (US)

(73) Assignee: ATI PROPERTIES LLC, Albany, OR (US)

( * ) Notice: Subject to any disclaimer, the term of this patent is extended or adjusted under 35 U.S.C. 154(b) by 0 days.

(21) Appl. No.: 18/351,216

(22) Filed: Jul. 12, 2023

(65) Prior Publication Data

US 2025/0019798 A1 Jan. 16, 2025

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
None
See application file for complete search history.

(56) References Cited

U.S. PATENT DOCUMENTS

| | | | |
|---|---|---|---|
| 2,857,269 | A | 10/1958 | Vordahl |
| 2,893,864 | A | 7/1959 | Harris et al. |
| 2,918,367 | A | 12/1959 | Crossley et al. |
| 2,932,886 | A | 4/1960 | Althouse |
| 2,974,076 | A | 3/1961 | Vordahl |
| 3,015,292 | A | 1/1962 | Bridwell |
| 3,025,905 | A | 3/1962 | Haerr |
| 3,060,564 | A | 10/1962 | Corral |
| 3,082,083 | A | 3/1963 | Levy et al. |
| 3,117,471 | A | 1/1964 | O'Connell et al. |
| 3,131,059 | A | 4/1964 | Kaartela |
| 3,313,138 | A | 4/1967 | Spring et al. |
| 3,379,522 | A | 4/1968 | Vordahl |
| 3,436,277 | A | 4/1969 | Bomberger, Jr. et al. |
| 3,469,975 | A | 9/1969 | Bomberger, Jr. et al. |
| 3,489,617 | A | 1/1970 | Wuerfel |
| 3,565,591 | A | 2/1971 | Canonico et al. |
| 3,584,487 | A | 6/1971 | Carlson |
| 3,595,645 | A | 7/1971 | Hunter et al. |
| 3,605,477 | A | 9/1971 | Carlson |

(Continued)

FOREIGN PATENT DOCUMENTS

| | | | |
|---|---|---|---|
| CA | 974095 | A1 | 9/1975 |
| CA | 2787980 | A | 7/2011 |

(Continued)

OTHER PUBLICATIONS

English language machine translation of WO-2020101008-A1. Generated Oct. 18, 2023. (Year: 2023).*

(Continued)

*Primary Examiner* — Brian D Walck
(74) *Attorney, Agent, or Firm* — K&L Gates LLP

(57) ABSTRACT

A titanium alloy comprises, in weight percent based on total alloy weight: 3.5 to 4.5 aluminum; 1.0 to less than 3 tin; 1.0 to 3.0 zirconium; 2.0 to 5.5 molybdenum; 2.0 to 4.25 chromium; 0.01 to 0.03 silicon; titanium; and impurities; and wherein an aluminum equivalent value of the titanium alloy is 6.0 to 6.9.

21 Claims, 3 Drawing Sheets

(56) References Cited

U.S. PATENT DOCUMENTS 3,615,378 A 10/1971 Bomberger, Jr. et al.
3,622,406 A 11/1971 Vordahl
3,635,068 A 1/1972 Watmough et al.
3,649,259 A 3/1972 Heitman
3,676,225 A 7/1972 Owczarski et al.
3,686,041 A 8/1972 Lee
3,756,810 A 9/1973 Parris et al.
3,802,877 A 4/1974 Parris et al.
3,815,395 A 6/1974 Sass
3,833,363 A 9/1974 Bomberger, Jr. et al.
3,835,282 A 9/1974 Sass et al.
3,867,208 A 2/1975 Grekov et al.
3,922,899 A 12/1975 Fremont et al.
3,979,815 A 9/1976 Nakanose et al.
3,986,868 A 10/1976 Crossley
4,053,330 A 10/1977 Henricks et al.
4,067,734 A 1/1978 Curtis et al.
4,094,708 A 6/1978 Hubbard et al.
4,098,623 A 7/1978 Ibaraki et al.
4,120,187 A 10/1978 Mullen
4,121,953 A 10/1978 Hull
4,138,141 A 2/1979 Andersen
4,147,639 A 4/1979 Lee et al.
4,150,279 A 4/1979 Metcalfe et al.
4,163,380 A 8/1979 Masoner
4,197,643 A 4/1980 Burstone et al.
4,229,216 A 10/1980 Paton et al.
4,299,626 A 11/1981 Paton et al.
4,309,226 A 1/1982 Chen
4,472,207 A 9/1984 Kinoshita et al.
4,473,125 A 9/1984 Addudle et al.
4,482,398 A 11/1984 Eylon et al.
4,510,788 A 4/1985 Ferguson et al.
4,543,132 A 9/1985 Berczik et al.
4,614,550 A 9/1986 Leonard et al.
4,631,092 A 12/1986 Ruckle et al.
4,639,281 A 1/1987 Sastry et al.
4,668,290 A 5/1987 Wang et al.
4,687,290 A 8/1987 Prussas
4,688,290 A 8/1987 Hogg
4,690,716 A 9/1987 Sabol et al.
4,714,468 A 12/1987 Wang et al.
4,738,822 A 4/1988 Bania
4,798,632 A 1/1989 Yonezawa et al.
4,799,975 A 1/1989 Ouchi et al.
4,808,249 A 2/1989 Eyelon et al.
4,842,653 A 6/1989 Wirth et al.
4,851,055 A 7/1989 Eylon et al.
4,854,977 A 8/1989 Alheritiere et al.
4,857,269 A 8/1989 Wang et al.
4,878,966 A 11/1989 Alheritiere et al.
4,888,973 A 12/1989 Comley
4,889,170 A 12/1989 Mae et al.
4,911,884 A 3/1990 Chang
4,917,728 A 4/1990 Enright
4,919,728 A 4/1990 Kohl et al.
4,943,412 A 7/1990 Bania et al.
4,957,567 A 9/1990 Krueger et al.
4,975,125 A 12/1990 Chakrabarti et al.
4,980,127 A 12/1990 Parris et al.
5,026,520 A 6/1991 Bhowal et al.
5,032,189 A 7/1991 Eylon et al.
5,041,262 A 8/1991 Gigliotti, Jr.
5,074,907 A 12/1991 Amato et al.
5,080,727 A 1/1992 Aihara et al.
5,094,812 A 3/1992 Dulmaine et al.
5,141,566 A 8/1992 Kitayama et al.
5,156,807 A 10/1992 Nagata et al.
5,160,554 A 11/1992 Bania et al.
5,162,159 A 11/1992 Tenhover et al.
5,169,597 A 12/1992 Davidson et al.
5,173,134 A 12/1992 Chakrabarti et al.
5,201,457 A 4/1993 Kitayama et al.
5,244,517 A 9/1993 Kimura et al.
5,256,369 A 10/1993 Ogawa et al.
5,264,055 A 11/1993 Champin et al.
5,277,718 A 1/1994 Paxson et al.
5,310,522 A 5/1994 Culling
5,330,591 A 7/1994 Vasseur
5,332,454 A 7/1994 Meredith et al.
5,332,545 A 7/1994 Love
5,342,458 A 8/1994 Adams et al.
5,358,586 A 10/1994 Schutz
5,359,872 A 11/1994 Nashiki
5,360,496 A 11/1994 Kuhlman et al.
5,374,323 A 12/1994 Kuhlman et al.
5,399,212 A 3/1995 Chakrabarti et al.
5,442,847 A 8/1995 Semiatin et al.
5,472,526 A 12/1995 Gigliotti, Jr.
5,494,636 A 2/1996 Dupioron et al.
5,509,979 A 4/1996 Kimura
5,516,375 A 5/1996 Ogawa et al.
5,520,879 A 5/1996 Saito et al.
5,527,403 A 6/1996 Schirra et al.
5,545,262 A 8/1996 Hardee et al.
5,545,268 A 8/1996 Yashiki et al.
5,547,523 A 8/1996 Blankenship et al.
5,558,728 A 9/1996 Kobayashi et al.
5,580,665 A 12/1996 Taguchi et al.
5,600,989 A 2/1997 Segal et al.
5,649,280 A 7/1997 Blankenship et al.
5,658,403 A 8/1997 Kimura
5,662,745 A 9/1997 Takayama et al.
5,679,183 A 10/1997 Takagi et al.
5,698,050 A 12/1997 El-Soudani
5,758,420 A 6/1998 Schmidt et al.
5,759,305 A 6/1998 Benz et al.
5,759,484 A 6/1998 Kashii et al.
5,795,413 A 8/1998 Gorman
5,871,595 A 2/1999 Ahmed et al.
5,896,643 A 4/1999 Tanaka
5,897,830 A 4/1999 Abkowitz et al.
5,904,204 A 5/1999 Teraoka et al.
5,922,274 A 7/1999 Suzuki et al.
5,954,724 A 9/1999 Davidson
5,980,655 A 11/1999 Kosaka
6,002,118 A 12/1999 Kawano et al.
6,032,508 A 3/2000 Ashworth et al.
6,044,685 A 4/2000 Delgado et al.
6,053,993 A 4/2000 Reichman et al.
6,059,904 A 5/2000 Benz et al.
6,071,360 A 6/2000 Gillespie
6,077,369 A 6/2000 Kusano et al.
6,127,044 A 10/2000 Yamamoto et al.
6,132,526 A 10/2000 Carisey et al.
6,139,659 A 10/2000 Takahashi et al.
6,143,241 A 11/2000 Hajaligol et al.
6,187,045 B1 2/2001 Fehring et al.
6,197,129 B1 3/2001 Zhu et al.
6,200,685 B1 3/2001 Davidson
6,209,379 B1 4/2001 Nishida et al.
6,216,508 B1 4/2001 Matsubara et al.
6,228,189 B1 5/2001 Oyama et al.
6,250,812 B1 6/2001 Ueda et al.
6,258,182 B1 7/2001 Schetky et al.
6,284,071 B1 9/2001 Suzuki et al.
6,332,935 B1 12/2001 Gorman et al.
6,334,350 B1 1/2002 Shin et al.
6,334,912 B1 1/2002 Ganin et al.
6,384,388 B1 5/2002 Anderson et al.
6,387,197 B1 5/2002 Bewlay et al.
6,391,128 B2 5/2002 Ueda et al.
6,399,215 B1 6/2002 Zhu et al.
6,402,859 B1 6/2002 Ishii et al.
6,409,852 B1 6/2002 Lin et al.
6,532,786 B1 3/2003 Luttgeharm
6,536,110 B2 3/2003 Smith et al.
6,539,607 B1 4/2003 Fehring et al.
6,539,765 B2 4/2003 Gates
6,558,273 B2 5/2003 Kobayashi et al.
6,561,002 B2 5/2003 Okada et al.
6,569,270 B2 5/2003 Segal
6,576,068 B2 6/2003 Grubb et al.
6,607,693 B1 8/2003 Saito et al.

(56) References Cited

U.S. PATENT DOCUMENTS 6,632,304 B2 10/2003 Oyama et al.
6,632,396 B1 10/2003 Tetjukhin et al.
6,663,501 B2 12/2003 Chen
6,726,784 B2 4/2004 Oyama et al.
6,742,239 B2 6/2004 Lee et al.
6,764,647 B2 7/2004 Aigner et al.
6,773,520 B1 8/2004 Fehring et al.
6,786,985 B2 9/2004 Kosaka et al.
6,800,153 B2 10/2004 Shii et al.
6,800,243 B2 10/2004 Tetyukhin et al.
6,823,705 B2 11/2004 Fukada et al.
6,908,517 B2 6/2005 Segal et al.
6,918,971 B2 7/2005 Fujii et al.
6,921,441 B2 7/2005 Tanaka et al.
6,932,877 B2 8/2005 Raymond et al.
6,939,415 B2 9/2005 Iseda et al.
6,954,525 B2 10/2005 Deo et al.
6,971,256 B2 12/2005 Okada et al.
7,008,489 B2 3/2006 Bania
7,008,491 B2 3/2006 Woodfield
7,010,950 B2 3/2006 Cai et al.
7,032,426 B2 4/2006 Durney et al.
7,037,389 B2 5/2006 Barbier et al.
7,038,426 B2 5/2006 Hill
7,081,173 B2 7/2006 Bahar et al.
7,083,687 B2 8/2006 Tanaka et al.
7,096,596 B2 8/2006 Hernandez, Jr. et al.
7,132,021 B2 11/2006 Kuroda et al.
7,152,449 B2 12/2006 Durney et al.
7,264,682 B2 9/2007 Chandran et al.
7,269,986 B2 9/2007 Pfaffmann et al.
7,332,043 B2 2/2008 Tetyukhin et al.
7,410,610 B2 8/2008 Woodfield et al.
7,438,849 B2 10/2008 Kuramoto et al.
7,449,075 B2 11/2008 Woodfield et al.
7,536,892 B2 5/2009 Amino et al.
7,559,221 B2 7/2009 Horita et al.
7,601,232 B2 10/2009 Fonte
7,611,592 B2 11/2009 Davis et al.
7,708,841 B2 5/2010 Saller et al.
7,837,812 B2 11/2010 Marquardt et al.
7,879,286 B2 2/2011 Miracle et al.
7,947,136 B2 5/2011 Saller
7,984,635 B2 7/2011 Callebaut et al.
8,037,730 B2 10/2011 Polen et al.
8,043,446 B2 10/2011 Jung et al.
8,048,240 B2 11/2011 Hebda et al.
8,128,764 B2 3/2012 Miracle et al.
8,211,548 B2 7/2012 Chun et al.
8,226,568 B2 7/2012 Watson et al.
8,311,706 B2 11/2012 Lu et al.
8,316,687 B2 11/2012 Slattery
8,336,359 B2 12/2012 Werz
8,408,039 B2 4/2013 Cao et al.
8,430,075 B2 4/2013 Qiao et al.
8,454,765 B2 6/2013 Saller et al.
8,454,768 B2 6/2013 Fanning
8,499,605 B2 8/2013 Bryan
8,551,264 B2 10/2013 Kosaka et al.
8,568,540 B2 10/2013 Marquardt et al.
8,578,748 B2 11/2013 Huskamp et al.
8,597,442 B2 12/2013 Hebda et al.
8,597,443 B2 12/2013 Hebda et al.
8,608,913 B2 12/2013 Shim et al.
8,613,818 B2 12/2013 Forbes Jones et al.
8,623,155 B2 1/2014 Marquardt et al.
8,652,400 B2 2/2014 Forbes Jones et al.
8,679,269 B2 3/2014 Goller et al.
8,771,590 B2 7/2014 Valentinovich et al.
8,834,653 B2 9/2014 Bryan
8,919,168 B2 12/2014 Valiev et al.
9,034,247 B2 5/2015 Suzuki et al.
9,050,647 B2 6/2015 Thomas et al.
9,192,981 B2 11/2015 Forbes Jones et al.
9,206,497 B2 12/2015 Bryan et al.
9,255,316 B2 2/2016 Bryan
9,327,342 B2 5/2016 Oppenheimer et al.
9,399,806 B2 7/2016 Soniak et al.
9,523,137 B2 12/2016 Marquardt et al.
9,574,250 B2 2/2017 Nagao et al.
9,616,480 B2 4/2017 Forbes Jones et al.
9,624,567 B2 4/2017 Bryan et al.
9,732,408 B2 8/2017 Sanz et al.
9,765,420 B2 9/2017 Bryan
9,777,361 B2 10/2017 Thomas et al.
9,796,005 B2 10/2017 Hebda et al.
9,869,003 B2 1/2018 Forbes Jones et al.
9,957,836 B2 5/2018 Sun et al.
10,023,942 B2 7/2018 Schutz et al.
10,053,758 B2 8/2018 Bryan
10,094,003 B2 10/2018 Foltz, IV
10,144,999 B2 12/2018 Bryan
10,287,655 B2 5/2019 Forbes Jones et al.
10,337,093 B2 7/2019 Forbes Jones et al.
10,370,741 B2 8/2019 Forbes Jones et al.
10,370,751 B2 8/2019 Thomas et al.
10,422,027 B2 9/2019 Marquardt et al.
10,435,775 B2 10/2019 Forbes Jones et al.
10,502,252 B2 12/2019 Foltz et al.
10,513,755 B2 12/2019 Bryan
10,570,469 B2 2/2020 Forbes Jones et al.
10,619,226 B2 4/2020 Foltz et al.
10,808,298 B2 10/2020 Foltz et al.
10,913,991 B2 2/2021 Mantione et al.
11,001,909 B2 5/2021 Mantione et al.
11,111,552 B2 9/2021 Foltz et al.
11,268,179 B2 3/2022 Mantione et al.
11,319,616 B2 5/2022 Foltz, IV
11,384,413 B2 7/2022 Mantione et al.
11,674,200 B2 6/2023 Garcia-Avila et al.
11,851,734 B2 12/2023 Foltz, IV
2002/0033717 A1 3/2002 Matsuo
2003/0168138 A1 9/2003 Marquardt
2004/0099350 A1 5/2004 Manitone et al.
2004/0148997 A1 8/2004 Amino et al.
2004/0221929 A1 11/2004 Hebda et al.
2004/0231756 A1* 11/2004 Bania ..... C22C 14/00 148/421
2004/0250932 A1 12/2004 Briggs
2005/0028905 A1 2/2005 Riffee, Jr.
2005/0047952 A1 3/2005 Coleman
2005/0145310 A1 7/2005 Bewlay et al.
2006/0045789 A1 3/2006 Nasserrafi et al.
2006/0110614 A1 5/2006 Liimatainen
2006/0243356 A1 11/2006 Oikawa et al.
2007/0009858 A1 1/2007 Hatton et al.
2007/0017273 A1 1/2007 Haug et al.
2007/0098588 A1 5/2007 Narita et al.
2007/0193662 A1 8/2007 Jablokov et al.
2008/0000554 A1 1/2008 Yaguchi et al.
2008/0103543 A1 5/2008 Li et al.
2008/0107559 A1 5/2008 Nishiyama et al.
2008/0181808 A1 7/2008 Thamboo et al.
2008/0202189 A1 8/2008 Otaki
2008/0210345 A1 9/2008 Tetyukhin et al.
2008/0264932 A1 10/2008 Hirota
2009/0000706 A1 1/2009 Huron et al.
2009/0180918 A1 7/2009 Tsai et al.
2009/0183804 A1 7/2009 Zhao et al.
2009/0214345 A1* 8/2009 DeMania ..... F01D 5/14 416/182
2009/0234385 A1 9/2009 Cichocki et al.
2010/0326571 A1 12/2010 Deal et al.
2011/0183151 A1 7/2011 Yokoyama et al.
2012/0067100 A1 3/2012 Stefansson et al.
2012/0076611 A1 3/2012 Bryan
2012/0076686 A1 3/2012 Bryan
2012/0279351 A1 11/2012 Gu et al.
2013/0062003 A1 3/2013 Shulkin et al.
2013/0156628 A1 6/2013 Forbes Jones et al.
2014/0261922 A1 9/2014 Thomas et al.
2015/0129093 A1 5/2015 Forbes Jones et al.
2016/0326612 A1 11/2016 Gudipati et al.
2017/0275735 A1 9/2017 Tetyukhin et al.

(56) References Cited

U.S. PATENT DOCUMENTS

| | | | |
|---|---|---|---|
| 2018/0195155 | A1 | 7/2018 | Bryan |
| 2018/0200766 | A1 | 7/2018 | Kunieda et al. |
| 2020/0024696 | A1 | 1/2020 | Foltz, IV |
| 2020/0032833 | A1 | 1/2020 | Foltz, IV et al. |
| 2020/0071806 | A1 | 3/2020 | Mantione et al. |
| 2022/0396860 | A1 | 12/2022 | Mantione et al. |
| 2023/0090733 | A1 | 3/2023 | Mantione et al. |
| 2024/0010213 | A1 | 3/2024 | Garcia-Avila et al. |

FOREIGN PATENT DOCUMENTS

| | | | | |
|---|---|---|---|---|
| CN | 1070230 | A | | 3/1993 |
| CN | 1194871 | A | | 9/1998 |
| CN | 1403622 | | | 3/2003 |
| CN | 1816641 | A | | 8/2006 |
| CN | 1932058 | A | | 3/2007 |
| CN | 1954087 | A | | 4/2007 |
| CN | 101104898 | A | | 1/2008 |
| CN | 101205593 | A | | 6/2008 |
| CN | 101294264 | A | | 10/2008 |
| CN | 101372729 | A | | 2/2009 |
| CN | 101503771 | A | | 8/2009 |
| CN | 101514412 | A | | 8/2009 |
| CN | 101597703 | A | | 12/2009 |
| CN | 101684630 | A | | 3/2010 |
| CN | 101760667 | A | * | 6/2010 |
| CN | 101886189 | A | | 11/2010 |
| CN | 101637789 | B | | 8/2011 |
| CN | 102212716 | A | | 10/2011 |
| CN | 102816953 | A | | 12/2012 |
| CN | 102952968 | A | | 3/2013 |
| CN | 103097560 | A | | 5/2013 |
| CN | 104169449 | A | | 11/2014 |
| CN | 101967581 | B | | 3/2015 |
| CN | 105671366 | A | | 6/2016 |
| CN | 107254603 | A | | 10/2017 |
| DE | 19743802 | A1 | | 3/1999 |
| DE | 10128199 | A1 | | 12/2002 |
| DE | 102010009185 | A1 | | 11/2011 |
| EP | 0066361 | A2 | | 12/1982 |
| EP | 0109350 | A2 | | 5/1984 |
| EP | 0243056 | A1 | | 10/1987 |
| EP | 0320820 | A1 | | 6/1989 |
| EP | 0535817 81 | | | 4/1995 |
| EP | 0611831 | B1 | | 1/1997 |
| EP | 0834580 | A1 | | 4/1998 |
| EP | 0870845 | A1 | | 10/1998 |
| EP | 0707085 | B1 | | 1/1999 |
| EP | 0683242 | B1 | | 5/1999 |
| EP | 0969109 | A1 | | 1/2000 |
| EP | 1083243 | A2 | | 3/2001 |
| EP | 1136582 | A1 | | 9/2001 |
| EP | 1302554 | A1 | | 4/2003 |
| EP | 1302555 | A1 | | 4/2003 |
| EP | 1433863 | | | 6/2004 |
| EP | 1471158 | A1 | | 10/2004 |
| EP | 1605073 | A1 | | 12/2005 |
| EP | 1612289 | A2 | | 1/2006 |
| EP | 1375690 | B1 | | 3/2006 |
| EP | 1717330 | A1 | | 11/2006 |
| EP | 1882752 | A2 | | 1/2008 |
| EP | 2028435 | A1 | | 2/2009 |
| EP | 2281908 | A1 | | 2/2011 |
| EP | 1546429 | B1 | | 6/2012 |
| FR | 2545104 | A1 | | 11/1984 |
| GB | 847103 | | | 9/1960 |
| GB | 888865 | | | 2/1962 |
| GB | 1170997 | A | | 11/1969 |
| GB | 1345048 | | | 1/1974 |
| GB | 1356734 | A | | 6/1974 |
| GB | 1433306 | | | 4/1976 |
| GB | 1479855 | | | 7/1977 |
| GB | 2161260 | A | | 7/1985 |
| GB | 2198144 | A | | 6/1988 |
| GB | 2337762 | A | | 12/1999 |
| JP | 55-113865 | A | | 9/1980 |
| JP | 57-62820 | A | | 4/1982 |
| JP | 57-62846 | A | | 4/1982 |
| JP | S57-202935 | A | | 12/1982 |
| JP | S58-210158 | A | | 12/1983 |
| JP | 60-046358 | | | 3/1985 |
| JP | 60-100655 | A | | 6/1985 |
| JP | S60-190519 | A | | 9/1985 |
| JP | S61-217564 | A | | 9/1986 |
| JP | S61-270356 | A | | 11/1986 |
| JP | 62-109956 | A | | 5/1987 |
| JP | 62-149859 | A | | 7/1987 |
| JP | 62-127074 | A | | 8/1987 |
| JP | S62-227597 | A | | 10/1987 |
| JP | S62-247023 | A | | 10/1987 |
| JP | S62-267438 | A | | 11/1987 |
| JP | S61-060871 | | | 3/1988 |
| JP | S63-49302 | A | | 3/1988 |
| JP | S63-188426 | A | | 8/1988 |
| JP | H01-272750 | A | | 10/1989 |
| JP | 1-279736 | A | | 11/1989 |
| JP | 2-205661 | A | | 8/1990 |
| JP | 3-134124 | A | | 6/1991 |
| JP | H03-138343 | A | | 6/1991 |
| JP | H03-155427 | A | | 7/1991 |
| JP | H03-166350 | A | | 7/1991 |
| JP | H03-264618 | A | | 11/1991 |
| JP | H03-274238 | A | | 12/1991 |
| JP | 4-74856 | A | | 3/1992 |
| JP | 4-103737 | A | | 4/1992 |
| JP | 4-143236 | A | | 5/1992 |
| JP | 4-168227 | A | | 6/1992 |
| JP | 5-59510 | A | | 3/1993 |
| JP | 5-117791 | A | | 5/1993 |
| JP | H05-148599 | A | | 6/1993 |
| JP | 5-195175 | A | | 8/1993 |
| JP | H05-293555 | A | | 11/1993 |
| JP | H06-93389 | A | | 4/1994 |
| JP | H06-212378 | A | | 8/1994 |
| JP | 8-300044 | A | | 11/1996 |
| JP | 9-143650 | | | 6/1997 |
| JP | 9-194969 | A | | 7/1997 |
| JP | 9-215786 | A | | 8/1997 |
| JP | H10-128459 | A | | 5/1998 |
| JP | H10-306335 | A | | 11/1998 |
| JP | H11-21642 | A | | 1/1999 |
| JP | H11-309521 | A | | 11/1999 |
| JP | H11-319958 | A | | 11/1999 |
| JP | 11-343528 | A | | 12/1999 |
| JP | 11-343548 | A | | 12/1999 |
| JP | 2000-153372 | A | | 6/2000 |
| JP | 2000-234887 | A | | 8/2000 |
| JP | 2001-71037 | A | | 3/2001 |
| JP | 2001-081537 | A | | 3/2001 |
| JP | 2001-343472 | A | | 12/2001 |
| JP | 2002-69591 | A | | 3/2002 |
| JP | 2002-146497 | A | | 5/2002 |
| JP | 2003-55749 | A | | 2/2003 |
| JP | 2003-73762 | A | | 3/2003 |
| JP | 2003-74566 | A | | 3/2003 |
| JP | 3409278 | B2 | | 5/2003 |
| JP | 2003-193159 | A | | 7/2003 |
| JP | 2003-285126 | A | | 10/2003 |
| JP | 2003-293051 | A | | 10/2003 |
| JP | 2003-334633 | A | | 11/2003 |
| JP | 2004-10963 | A | | 1/2004 |
| JP | 2004-131761 | | | 4/2004 |
| JP | 2004-532785 | A | | 10/2004 |
| JP | 2005-281855 | A | | 10/2005 |
| JP | 2005-320570 | A | | 11/2005 |
| JP | 2006213961 | A | * | 8/2006 |
| JP | 2007-291488 | A | | 11/2007 |
| JP | 2007-327118 | A | | 12/2007 |
| JP | 2008-200730 | A | | 9/2008 |
| JP | 2009-138218 | A | | 6/2009 |
| JP | 2009-167502 | A | | 7/2009 |
| JP | WO 2009/142228 | A1 | | 11/2009 |
| JP | 2009-299110 | A | | 12/2009 |
| JP | 2009-299120 | A | | 12/2009 |

(56) References Cited

FOREIGN PATENT DOCUMENTS

| | | | |
|---|---|---|---|
| JP | 2010-70833 | A | 4/2010 |
| JP | 2012-057200 | A | 3/2012 |
| JP | 2012-140690 | A | 7/2012 |
| JP | 2012-180542 | A | 9/2012 |
| JP | 5592818 | B2 | 9/2014 |
| JP | 2015-4100 | A | 1/2015 |
| JP | 2015-54332 | A | 3/2015 |
| JP | 2017-210858 | A | 11/2017 |
| JP | 6454768 | B2 | 1/2019 |
| KR | 920004946 | | 8/1992 |
| KR | 10-2005-0087785 | A | 8/2005 |
| KR | 10-2009-0069647 | A | 7/2009 |
| KR | 10-2011-0069602 | A | 6/2011 |
| RU | 2003417 | C1 | 11/1993 |
| RU | 2009755 | C1 | 3/1994 |
| RU | 1131234 | C | 10/1994 |
| RU | 1593259 | C | 11/1994 |
| RU | 2156828 | C1 | 9/2000 |
| RU | 2197555 | C1 | 7/2001 |
| RU | 2172359 | C1 | 8/2001 |
| RU | 2217260 | C1 | 11/2003 |
| RU | 2234998 | C1 | 8/2004 |
| RU | 2256713 | C1 | 7/2005 |
| RU | 2269584 | C1 | 2/2006 |
| RU | 2288967 | C1 | 12/2006 |
| RU | 2364660 | C1 | 8/2009 |
| RU | 2368695 | C1 | 9/2009 |
| RU | 2378410 | C1 | 1/2010 |
| RU | 2392348 | C2 | 6/2010 |
| RU | 2393936 | C1 | 7/2010 |
| RU | 2413030 | C1 | 2/2011 |
| RU | 2441089 | C1 | 1/2012 |
| RU | 2447185 | C1 | 4/2012 |
| RU | 2581332 | C2 | 4/2016 |
| RU | 2610657 | C1 | 2/2017 |
| RU | 2614356 | C1 | 3/2017 |
| RU | 2618016 | C2 | 5/2017 |
| RU | 2690257 | C1 | 5/2019 |
| RU | 2772375 | C2 | 5/2022 |
| SU | 524847 | A | 11/1976 |
| SU | 534518 | A1 | 1/1977 |
| SU | 631234 | A | 11/1978 |
| SU | 1077328 | A | 5/1982 |
| SU | 1135798 | A1 | 1/1985 |
| SU | 1088397 | A1 | 2/1991 |
| UA | 38805 | A | 5/2001 |
| UA | 40862 | A | 8/2001 |
| UA | a200813448 | | 6/2008 |
| UA | 111002 | C2 | 3/2016 |
| WO | WO 98/17836 | A1 | 4/1998 |
| WO | WO 98/22629 | A | 5/1998 |
| WO | WO 02/36847 | A2 | 5/2002 |
| WO | WO 02/070763 | A1 | 9/2002 |
| WO | WO 02/086172 | A1 | 10/2002 |
| WO | WO 02/090607 | A1 | 11/2002 |
| WO | WO 03/052155 | A1 | 6/2003 |
| WO | WO 2004/101838 | A1 | 11/2004 |
| WO | WO 2004/106569 | A1 | 12/2004 |
| WO | WO 2006/071192 | A1 | 7/2006 |
| WO | WO 2007/084178 | A2 | 7/2007 |
| WO | WO 2007/114439 | A1 | 10/2007 |
| WO | WO 2007/142379 | A1 | 12/2007 |
| WO | WO 2008/017257 | A1 | 2/2008 |
| WO | WO 2009/082498 | A1 | 7/2009 |
| WO | WO 2009/102233 | A1 | 8/2009 |
| WO | WO 2010/084883 | A1 | 7/2010 |
| WO | WO 2010/138886 | A1 | 12/2010 |
| WO | WO 2012/039929 | A1 | 3/2012 |
| WO | WO 2012/063504 | A1 | 5/2012 |
| WO | WO 2012/147742 | A1 | 11/2012 |
| WO | WO 2013/081770 | A1 | 6/2013 |
| WO | WO 2013/130139 | A2 | 9/2013 |
| WO | WO 2015/168131 | A1 | 11/2015 |
| WO | WO 2016/114958 | A1 | 7/2016 |
| WO | WO 2017/018511 | A1 | 2/2017 |
| WO | WO 2017/018514 | A1 | 2/2017 |
| WO | WO-2020101008 | A1 * | 5/2020 ..... B21F 1/00 |

OTHER PUBLICATIONS

English language machine translation of CN-101760667-A. Generated Oct. 18, 2023. (Year: 2023).*

English language machine translation of JP-2006213961-A. Generated Oct. 18, 2023. (Year: 2023).*

"Allvac TiOsteum and TiOstalloy Beat Titanium Alloys", printed from www.allvac.com/allvac/pages/Titanium/TiOsteum.htm on Nov. 7, 2005.

"Datasheet: Timetal 21S", Alloy Digest, Advanced Materials and Processes (Sep. 1998), pp. 38-39.

"Heat Treating of Nonferrous Alloys: Heat Treating of Titanium and Titanium Alloys," Metals Handbook, ASM Handbooks Online (2002).

"Stryker Orthopaedics TMZF® Alloy (UNS R58120)", printed from www.allvac.com/allvac/pages/Titanium/UNSR58120.htm on Nov. 7, 2005.

"Technical Data Sheet: Allvac® Ti—15Mo Beta Titanium Alloy" (dated Jun. 16, 2004).

ASM Materials Engineering Dictionary, "Blasting or Blast Cleaning," J.R. Davis Ed., ASM International, Materials Park, OH (1992) p. 42.

"ASTM Designation F1801-97 Standard Practice for Corrosion Fatigue Testing of Metallic Implant Materials" ASTM Intemational (1997) pp. 876-880.

"ASTM Designation F2066-01 Standard Specification for Wrought Titanium-15 Molybdenum Alloy for Surgical Implant Applications (UNS R58150)," ASTM International (2000) pp. 1-4.

AL-6XN® Alloy (UNS N08367) Allegheny Ludlum Corporation, 2002, 56 pages.

Allegheny Ludlum, "High Performance Metals for Industry, High Strength, High Temperature, and Corrosion-Resistant Alloys", (2000) pp. 1-8.

Allvac, Product Specification for "Allvac Ti-15 Mo," available at http://www.allvac.com/allvac/pages/Titanium/Ti15MO.htm, last visited Jun. 9, 2003 p. 1 of 1.

Altemp@ A286 Iron-Base Superalloy (UNS Designation S66286) Allegheny Ludlum Technical Data Sheet Blue Sheet. 1998, 8 pages.

ASM Materials Engineering Dictionary, J.R. Davis Ed., ASM International, Materials Park, OH (1992) p. 39.

ATI Datalloy 2 Alloy, Technical Data Sheet, ATI Allvac, Monroe, NC, SS-844, Version1, Sep. 17, 2010, 8 pages.

ATI 38-644™ Beta Titanium Alloy Technical Data Sheet, UNS R58640, Version 1, Dec. 21, 2011, 4 pages.

ATI 690 (UNS N06690) Nickel-Base, ATI Allvac, Oct. 5, 2010, 1 page.

Isothermal forging definition, ASM Materials Engineering Dictionary, J.R. Davis ed., Fifth Printing, Jan. 2006, ASM International, p. 238.

Isothermal forging, printed from http://thelibraryofmanufacturing.com/isothermal_forging.html, accessed Jun. 5, 2013, 3 pages.

Adiabatic definition, ASM Materials Engineering Dictionary, J.R. Davis ed., Fifth Printing, Jan. 2006, ASM International, p. 9.

Adiabatic process—Wikipedia, the free encyclopedia, printed from http://en.wikipedia.org/wiki/Adiabatic_process, accessed May 21, 2013, 10 pages.

ASTM Designation F 2066-01, "Standard Specification for Wrought Titanium-15 Molybdenum Alloy for Surgical Implant Applications (UNS R58150)", May 2001, 7 pages.

ASTM Designation F 2066/F2066M-13, "Standard Specification for Wrought Titanium-15 Molybdenum Alloy for Surgical Implant Applications (UNS R58150)", Nov. 2013, 6 pages.

ATI 6-2-4-2™ Alloy Technical Data Sheet, Version 1, Feb. 26, 2012, 4 pages.

ATI 6-2-4-6™ Titanium Alloy Data Sheet, accessed Jun. 26, 2012.

ATI 425, High-Strength Titanium Alloy, Alloy Digest, ASM International, Jul. 2004, 2 pages.

(56) References Cited

OTHER PUBLICATIONS

ATI 425® Alloy Applications, retrieved from http://web.archive.org/web/20100704044024/http://www.alleghenytechnologies.com/ATI425/applications/default.asp#other, Jul. 4, 2010, Way Back Machine, 2 pages.
ATI 425® Alloy, Technical Data Sheet, retrieved from http://web.archive.org/web/20100703120218/http://www.alleghenytechnologies.com/ATI425/specifications/datasheet.asp, Jul. 3, 2010, Way Back Machine, 5 pages.
ATI 425®-MIL Alloy, Technical Data Sheet, Version 1, May 28, 2010, pp. 1-5.
ATI 425®-MIL Alloy, Technical Data Sheet, Version 2, Aug. 16, 2010, 5 pages.
ATI 425®-MIL Titanium Alloy, Mission Critical Metallics®, Version 3, Sep. 10, 2009, pp. 1-4.
ATI 425® Titanium Alloy, Grade 38 Technical Data Sheet, Version 1, Feb. 1, 2012, pp. 1-6.
ATI 425® Alloy, Grade 38, Titanium Alloy, UNS R54250, Technical Data Sheet, Version 1, Nov. 25, 2013, pp. 1-6.
ATI 500-MIL™, Mission Critical Metallics®, High Hard Specialty Steel Armor, Version 4, Sep. 10, 2009, pp. 1-4.
ATI 600-MIL®, Preliminary Draft Data Sheet, Ultra High Hard Specialty Steel Armor, Version 4, Aug. 10, 2010, pp. 1-3.
ATI 600-MIL™, Preliminary Draft Data Sheet, Ultra High Hard Specialty Steel Armor, Version 3, Sep. 10, 2009, pp. 1-3.
ATI Aerospace Materials Development, Mission Critical Metallics, Apr. 30, 2008, 17 pages.
ATI Ti—15Mo Beta Titanium Alloy Technical Data Sheet, ATI Allvac, Monroe, NC, Mar. 21, 2008, 3 pages.
ATI Titanium 6Al—2Sn—4Zr—2Mo Alloy, Technical Data Sheet, Version 1, Sep. 17, 2010, pp. 1-3.
ATI Titanium 6Al—4V Alloy, Mission Critical Metallics®, Technical Data Sheet, Version 1, Apr. 22, 2010, pp. 1-3.
ATI Wah Chang, ATI™ 425 Titanium Alloy (Ti—4Al—2.5V—1.5Fe-0.2502), Technical Data Sheet, 2004, pp. 1-5.
ATI Wah Chang, Titanium and Titanium Alloys, Technical Data Sheet, 2003, pp. 1-16.
Beal et al., "Forming of Titanium and Titanium Alloys—Cold Forming", ASM Handbook, 2006, ASM International, vol. 14B, 2 pages.
Beal et al., "Forming of Titanium and Titanium Alloys—Cold Forming", ASM Handbook, 2006, ASM International, Revised by ASM Committee on Forming Titanium Alloys, vol. 14B, 2 pages.
Beal et al., "Forming of Titanium and Titanium Alloys—Cold Forming", ASM Handbook, 2006, vol. 14B, pp. 656-669.
Bewlay, et al., "Superplastic roll forming of Ti alloys", Materials and Design, 21, 2000, pp. 287-295.
Bowen, A. W., "Omega Phase Embrittlement in Aged Ti—15% Mo," Scripta Metallurgica, vol. 5, No. 8 (1971) pp. 709-715.
Bowen, A. W., "On the Strengthening of a Metastable b-Titanium Alloy by w- and a-Precipitation" Royal Aircraft Establishment Technical Memorandum Mat 338, (1980) pp. 1-15 and Figs 1-5.
Boyer, Rodney R., "Introduction and Overview of Titanium and Titanium Alloys: Applications," Metals Handbook, ASM Handbooks Online (2002).
Boyko et al., "Modeling of the Open-Die and Radial Forging Processes for Alloy 718", Superalloys 718, 625 and Various Derivatives. Proceedings of the International Symposium on the Metallurgy and Applications of Superalloys 718, 625 and Various Derivatives, held Jun. 23, 1992, pp. 107-124.
Cain, Patrick, "Warm forming aluminum magnesium components; How it can optimize formability, reduce springback", Aug. 1, 2009, from http://www.thefabricator.com/article/presstechnology/warm-forming-aluminum-magnesium-components, 3 pages.
Callister, Jr., William D., Materials Science and Engineering, An Introduction, Sixth Edition, John Wiley & Sons, pp. 180-184 (2003).
Craighead et al., "Ternary Alloys of Titanium", Journal of Metals, Mar. 1950, Transactions AIME, vol. 188, pp. 514-538.
Craighead et al., "Titanium Binary Alloys", Journal of Metals, Mar. 1950, Transactions AIME, vol. 188, pp. 485-513.
Desrayaud et al., "A novel high straining process for bulk materials—The development of a multipass forging system by compression along three axes", Journal of Materials Processing Technology, 172, 2006, pp. 152-158.
Diderrich et al., "Addition of Cobalt to the Ti—6Al—4V Alloy", Journal of Metals, May 1968, pp. 29-37.
DiDomizio, et al., "Evaluation of a Ni—20Cr Alloy Processed by Multi-axis Forging", Materials Science Forum vols. 503-504, 2006, pp. 793-798.
Disegi, J. A., "Titanium Alloys for Fracture Fixation Implants," Injury International Journal of the Care of the Injured, vol. 31 (2000) pp. S-D14-S-D17.
Disegi, John, Wrought Titanium-15% Molybdenum Implant Material, Original Instruments and Implants of the Association for the Study of International Fixation—AO ASIF, Oct. 2003.
Donachie Jr., M.J., "Titanium a Technical Guide" 1988, ASM, pp. 39 and 46-50.
Donachie Jr., M.J., "Heat Treating Titanium and Its Alloys", Heat Treating Process, Jun./Jul. 2001, pp. 47-49, 52-53, and 56-57.
Duflou et al., "A method for force reduction in heavy duty bending", Int. J. Materials and Product Technology, vol. 32, No. 4, 2008, pp. 460-475.
Elements of Metallurgy and Engineering Alloys, Editor F. C. Campbell, ASM International, 2008, Chapter 8, p. 125.
Fedotov, S.G. et al., "Effect of Aluminum and Oxygen on the Formation of Metastable Phases in Alloys of Titanium with .beta.-Stabilizing Elements", Izvestiya Akademii Nauk SSSR, Metally (1974) pp. 121-126.
Froes, F.H. et al., "The Processing Window for Grain Size Control in Metastable Beta Titanium Alloys", Beta Titanium Alloys in the 80's, ed. by R. Boyer and H. Rosenberg, AIME, 1984, pp. 161-164.
Gigliotti et al., "Evaluation of Superplastically Roll Formed VT-25", Titamium'99, Science and Technology, 2000, pp. 1581-1588.
Gilbert et al., "Heat Treating of Titanium and Titanium Alloys—Solution Treating and Aging", ASM Handbook, 1991, ASM International, vol. 4, pp. 1-8.
Glazunov et al., Structural Titanium Alloys, Moscow, Metallurgy, 1974, pp. 264-283.
Greenfield, Dan L., News Release, ATI Aerospace Presents Results of Year-Long Characterization Program for New ATI 425 Alloy Titanium Products at Aeromat 2010, Jun. 21, 2010, Pittsburgh, Pennsylvania, 1 page.
Harper, Megan Lynn, "A Study of the Microstructural and Phase Evolutions in Timetal 555", Jan. 2004, retrieved from http://www.ohiolink.edu/etd/send-pdf.cgi/harper%20megan%20lynn.pdf?acc_num=osu1132165471 on Aug. 10, 2009, 92 pages.
Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Ho, W.F. et al., "Structure and Properties of Cast Binary Ti—Mo Alloys" Biomaterials, vol. 20 (1999) pp. 2115-2122.
Hsieh, Chih-Chun and Weite Wu, "Overview of Intermetallic Sigma Phase Precipitation in Stainless Steels", ISRN Metallurgy, vol. 2012, 2012, pp. 1-16.
Imatani et al., "Experiment and simulation for thick-plate bending by high frequency inductor", ACTA Metallurgica Sinica, vol. 11, No. 6, Dec. 1998, pp. 449-455.
Imayev et al., "Formation of submicrocrystalline structure in TiAl intermetallic compound", Journal of Materials Science, 27, 1992, pp. 4465-4471.
Imayev et al., "Principles of Fabrication of Bulk Ultrafine-Grained and Nanostructured Materials by Multiple Isothermal Forging", Materials Science Forum, vols. 638-642, 2010, pp. 1702-1707.
Imperial Metal Industries Limited, Product Specification for "IMI Titanium 205", The Kynoch Press (England) pp. 1-5. (1965).
Jablokov et al., "Influence of Oxygen Content on the Mechanical Properties of Titanium-35Niobium-7Zirconium-5Tantalum Beta Titanium Alloy," Journal of ASTM International, Sep. 2005, vol. 2, No. 8, 2002, pp. 1-12.

(56) References Cited

OTHER PUBLICATIONS

Jablokov et al., "The Application of Ti-15 Mo Beta Titanium Alloy in High Strength Orthopaedic Applications", Journal of ASTM International, vol. 2, Issue 8 (Sep. 2005) (published online Jun. 22, 2005).
Kovtun, et al., "Method of calculating induction heating of steel sheets during thermomechanical bending", Kiev, Nikolaev, translated from Problemy Prochnosti, No. 5, pp. 105-110, May 1978, original article submitted Nov. 27, 1977, pp. 600-606.
Lampman, S., "Wrought and Titanium Alloys," ASM Handbooks Online, ASM International, 2002.
Lee et al., "An electromagnetic and thermo-mechanical analysis of high frequency induction heating for steel plate bending", Key Engineering Materials, vols. 326-328, 2006, pp. 1283-1286.
Lemons, Jack et al., "Metallic Biomaterials for Surgical Implant Devices," BoneZone, Fall (2002) p. 5-9 and Table.
Long, M. et al., "Friction and Surface Behavior of Selected Titanium Alloys During Reciprocating-Sliding Motion", WEAR, 249(1-2), Jan. 17, 2001, 158-168.
Lütjering, G. and J.C. Williams, Titanium, Springer, New York (2nd ed. 2007) p. 24.
Lutjering, G. and Williams, J.C., Titanium, Springer-Verlag, 2003, Ch. 5: Alpha+Beta Alloys, p. 177-201.
Marquardt et al., "Beta Titanium Alloy Processed for High Strength Orthopaedic Applications," Journal of ASTM International, vol. 2, Issue 9 (Oct. 2005) (published online Aug. 17, 2005).
Marquardt, Brian, "Characterization of Ti—15Mo for Orthopaedic Applications," TMS 2005 Annual Meeting: Technical Program, San Francisco, CA, Feb. 13-17, 2005 Abstract, p. 239.
Marquardt, Brian, "Ti—15Mo Beta Titanium Alloy Processed for High Strength Orthopaedic Applications," Program and Abstracts for the Symposium on Titanium, Niobium, Zirconium, and Tantalum for Medical and Surgical Applications, Washington, D.C., Nov. 9-10, 2004 Abstract, p. 11.
Marte et al., "Structure and Properties of NI-20CR Produced by Severe Plastic Deformation", Ultrafine Grained Materials IV, 2006, pp. 419-424.
Materials Properties Handbook: Titanium Alloys, Eds. Boyer et al, ASM International, Materials Park, OH, 1994, pp. 524-525.
Martinelli, Gianni and Roberto Peroni, "Isothermal forging of Ti-alloys for medical applications", Presented at the 11th World Conference on Titanium, Kyoto, Japan, Jun. 4-7, 2007, accessed Jun. 5, 2013, 5 pages.
McDevitt, et al., Characterization of the Mechanical Properties of ATI 425 Alloy According to the Guidelines of the Metallic Materials Properties Development & Standardization Handbook, Aeromat 2010 Conference and Exposition: Jun. 20-24, 2010, Bellevue, WA, 23 pages.
Metals Handbook, Desk Edition, 2nd ed., J. R. Davis ed., ASM International, Materials Park, Ohio (1998), pp. 575-588.
Military Standard, Fastener Test Methods, Method 13, Double Shear Test, MIL-STD-1312-13, Jul. 26, 1985, superseding MIL-STD-1312 (in part) May 31, 1967, 8 pages.
Military Standard, Fastener Test Methods, Method 13, Double Shear Test, MIL-STD-1312-13A, Aug. 23, 1991, superseding MIL-STD-13, Jul. 26, 1985, 10 pages.
Murray, J.L., et al., Binary Alloy Phase Diagrams, Second Edition, vol. 1, Ed. Massalski, Materials Park, OH; ASM International; 1990, p. 547.
Murray, J.L., The Mn—Ti (Manganese-Titanium) System, Bulletin of Alloy Phase Diagrams, vol. 2, No. 3 (1981) p. 334-343.
Myers, J., "Primary Working, A lesson from Titanium and its Alloys," ASM Course Book 27 Lesson, Test 9, Aug. 1994, pp. 3-4.
Naik, Uma M. et al., "Omega and Alpha Precipitation in Ti—15Mo Alloy," Titanium '80 Science and Technology—Proceedings of the 4th International Conference on Titanium, H. Kimura & O. Izumi Eds. May 19-22, 1980 pp. 1335-1341.
Nguyen et al., "Analysis of bending deformation in triangle heating of steel plates with induction heating process using laminated plate theory", Mechanics Based Design of Structures and Machines, 37, 2009, pp. 228-246.
Nishimura, T. "Ti—15Mo—5Zr—3Al", Materials Properties Handbook: Titanium Alloys, eds. R. Boyer et al., ASM International, Materials Park, OH, 1994, p. 949.
Novikov et al., 17.2.2 Deformable ($\alpha+\beta$) alloys, Chapter 17, Titanium and its Alloys, Metal Science, vol. II Thermal Treatment of the Alloy, Physical Matallurgy, 2009, pp. 357-360.
Nutt, Michael J. et al., "The Application of Ti-15 Beta Titanium Alloy in High Strength Structural Orthopaedic Applications," Program and Abstracts for the Symposium on Titanium Niobium, Zirconium, and Tantalum for Medical and Surgical Applications, Washington, D.C., Nov. 9-10, 2004 Abstract, p. 12.
Nyakana, et al., "Quick Reference Guide for β Titanium Alloys in the 00s", Journal of Materials Engineering and Performance, vol. 14, No. 6, Dec. 1, 2005, pp. 799-811.
Pennock, G.M. et al., "The Control of a Precipitation by Two Step Ageing in β Ti—15Mo," Titanium '80 Science and Technology—Proceedings of the 4th Intemational Conference on Titanium, H. Kimura & O. Izumi Eds. May 19-22, 1980 pp. 1344-1350.
Prasad, Y.V.R.K. et al. "Hot Deformation Mechanism in Ti—6Al—4V with Transformed B Starting Microstructure: Commercial v. Extra Low Interstitial Grade", Materials Science and Technology, Sep. 2000, vol. 16, pp. 1029-1036.
Qazi, J.I. et al., "High-Strength Metastable Beta-Titanium Alloys for Biomedical Applications," JOM, Nov. 2004 pp. 49-51.
Roach, M.D., et al., "Comparison of the Corrosion Fatigue Characteristics of CPTi-Grade 4, Ti-6A1-4V ELI, Ti-6A1-7 Nb, and Ti—15 Mo", Journal of Testing and Evaluation, vol. 2, Issue 7, (Jul./Aug. 2005) (published online Jun. 8, 2005).
Roach, M.D., et al., "Physical, Metallurgical, and Mechanical Comparison of a Low-Nickel Stainless Steel," Transactions on the 27th Meeting of the Society for Biomaterials, Apr. 24-29, 2001, p. 343.
Roach, M.D., et al., "Stress Corrosion Cracking of a Low-Nickel Stainless Steel," Transactions of the 27th Annual Meeting of the Society for Biomaterials, 2001, p. 469.
Rudnev et at., "Longitudinal flux indication heating of slabs, bars and strips is no longer "Black Magic:" II", Industrial Heating, Feb. 1995, pp. 46-48 and 50-51.
Russo, P.A., "Influence of Ni and Fe on the Creep of Beta Annealed Ti-6242S", Titanium '95: Science and Technology, pp. 1075-1082.
SAE Aerospace Material Specification 4897A (issued Jan. 1997, revised Jan. 2003).
SAE Aerospace, Aerospace Material Specification, Titanium Alloy Bars, Forgings and Forging Stock, 6.0Al—4.0V Annealed, AMS 6931A, Issued Jan. 2004, Revised Feb. 2007, pp. 1-7.
SAE Aerospace, Aerospace Material Specification, Titanium Alloy Bars, Forgings and Forging Stock, 6.0Al—4.0V, Solution Heat Treated and Aged, AMS 6930A, Issued Jan. 2004, Revised Feb. 2006, pp. 1-9.
SAE Aerospace, Aerospace Material Specification, Titanium Alloy, Sheet, Strip, and Plate, 4Al—2.5V—1.5Fe, Annealed, AMS 8948A, Issued Oct. 2006, Revised Jun. 2007, pp. 1-7.
Salishchev et al., "Characterization of Submicron-grained Ti—6Al—4V Sheets with Enhanced Superplastic Properties", Materials Science Forum, Trans Tech Publications, Switzerland, vols. 447-448, 2004, pp. 441-446.
Salishchev et al., "Mechanical Properties of Ti—6Al—4V Titanium Alloy with Submicrocrystalline Structure Produced by Multiaxial Forging", Materials Science Forum, vols. 584-586, 2008, pp. 783-788.
Salishchev, et al., "Effect of Deformation Conditions on Grain Size and Microstructure Homogeneity of β-Rich Titanium Alloys", Journal of Materials Engineering and Performance, vol. 14(6), Dec. 2005, pp. 709-716.
Salishchev, G.A., "Formation of submicrocrystalline structure in large size billets and sheets out of titanium alloys", Institute for Metals Superplasticity Problems, Ufa, Russia, presented at 2003 NATO Advanced Research Workshop, Kyiv, Ukraine, Sep. 9-13, 2003, 50 pages.

(56) References Cited

OTHER PUBLICATIONS

Semiatin, S.L. et al., "The Thermomechanical Processing of Alpha/Beta Titanium Alloys," Journal of Metals, Jun. 1997, pp. 33-39.
Semiatin et al., "Equal Channel Angular Extrusion of Difficult-to-Work Alloys", Materials & Design, Elsevier Science Ltd., 21, 2000, pp. 311-322.
Semiatin et al., "Alpha/Beta Heat Treatment of a Titanium Alloy with a Nonuniform Microstructure", Metallurgical and Materials Transactions A, vol. 38A, Apr. 2007, pp. 910-921.
Shahan et al., "Adiabatic shear bands in titanium and titanium alloys: a critical review", Materials & Design, vol. 14, No. 4, 1993, pp. 243-250.
SPS Titanium™ Titanium Fasteners, SPS Technologies Aerospace Fasteners, 2003, 4 pages.
Standard Specification for Wrought Titanium-6Aluminum-4Vanadium Alloy for Surgical Implant Applications (UNS R56400), Designation: F 1472-99, ASTM 1999, pp. 1-4.
Swann, P.R. and J. G. Parr, "Phase Transformations in Titanium-Rich Alloys of Titanium and Cobalt", Transactions of the Metallurgical Society of AIME, Apr. 1958, pp. 276-279.
Takemoto Y et al., "Tensile Behavior and Cold Workability of Ti—Mo Alloys", Materials Transactions Japan Inst. Metals Japan, vol. 45, No. 5, May 2004, pp. 1571-1576.
Tamarisakandala, S. et al., "Strain-induced Porosity During Cogging of Extra-Low Interstitial Grade Ti—6Al—4V", Journal of Materials Engineering and Performance, vol. 10(2), Apr. 2001, pp. 125-130.
Tamirisakandala et al., "Effect of boron on the beta transus of Ti—6Al—4V alloy", Scripta Materialia, 53, 2005, pp. 217-222.
Tamirisakandala et al., "Powder Metallurgy Ti—6Al—4V—xB Alloys: Processing, Microstructure, and Properties", JOM, May 2004, pp. 60-63.
Tebbe, Patrick A. and Ghassan T. Kridli, "Warm forming aluminum alloys: an overview and future directions", Int. J. Materials and Product Technology, vol. 21. Nos. 1-3, 2004, pp. 24-40.
Technical Presentation: Overview of MMPDS Characterization of ATI 425 Alloy, 2012, 1 page.
Ti—6Al—4V, Ti64, 6Al—4V, 6-4, UNS R56400, 1 page.
TIMET 6-6-2 Titanium Alloy (Ti—6Al—6V—2Sn), Annealed, accessed Jun. 27, 2012.
TIMET TIMETAL® 6-2-4-2 (Ti—6Al—2Sn—4Zr—2Mo—0.08Si) Titanium Alloy datasheet, accessed Jun. 26, 2012.
TIMET TIMETAL® 6-2-4-6 Titanium Alloy (Ti—6Al—2Sn—4Zr—6Mo), Typical, accessed Jun. 26, 2012.
Titanium 3Al—8V—6Cr—4Mo—4Zr Beta-C/Grade 19 UNS R58640, 2 pages.
Tokaji, Keiro et al., "The Microstructure Dependence of Fatigue Behavior in Ti—15Mo—5Zr—3Al Alloy," Materials Science and Engineering A., vol. 213 (1996) pp. 86-92.
Two new α-β titanium alloys, KS Ti-9 for sheet and KS EL-F for forging, with mechanical properties comparable to Ti—6Al—4V, Oct. 8, 2002, ITA 2002 Conference in Orlando, Hideto Oyama, Titanium Technology Dept., Kobe Steel, Ltd., 16 pages.
Veeck, S., et al., "The Castability of Ti-5553 Alloy," Advanced Materials and Processes, Oct. 2004, pp. 47-49.
Weiss, I. et al., "The Processing Window Concept of Beta Titanium Alloys", Recrystallization '90, ed. by T. Chandra, The Minerals, Metals & Materials Society, 1990, pp. 609-616.
Weiss, I. et al., "Thermomechanical Processing of Beta Titanium Alloys—An Overview," Material Science and Engineering, A243, 1998, pp. 46-65.
Williams, J., Thermo-mechanical processing of high-performance Ti alloys: recent progress and future needs, Journal of Material Processing Technology, 117 (2001), p. 370-373.
Yakymyshyn et al., "The Relationship between the Constitution and Mechanical Properties of Titanium-Rich Alloys of Titanium and Cobalt", 1961, vol. 53, pp. 283-294.
Zardiackas, L.D. et al., "Stress Corrosion Cracking Resistance of Titanium Implant Materials," Transactions of the 27th Annual Meeting of the Society for Biomaterials, (2001).
Zeng et al., Evaluation of Newly Developed Ti-555 High Strength Titanium Fasteners, 17th AeroMat Conference & Exposition, May 18, 2006, 2 pages.
Zhang et al., "Simulation of slip band evolution in duplex Ti—6Al—4V", Acta Materialia, vol. 58, (2010), Nov. 26, 2009, pp. 1087-1096.
Zherebtsov et al., "Production of submicrocrystalline structure in large-scale Ti—6Al—4V billet by warm severe deformation processing", Scripta Materialia, 51, 2004, pp. 1147-1151.
Titanium Alloy, Sheet, Strip, and Plate 4Al—2.5V—1.5Fe, Annealed, AMS6946 Rev. B, Aug. 2010, SAE Aerospace, Aerospace Material Specification, 7 pages.
Titanium Alloy, Sheet, Strip, and Plate 6Al—4V, Annealed, AMS 4911L, Jun. 2007, SAE Aerospace, Aerospace Material Specification, 7 pages.
E112-12 Standard Test Methods for Determining Average Grain Size, ASTM International, Jan. 2013, 27 pages.
ATI Datalloy 2 Alloy, Technical Data Sheet, ATI Properties, Inc., Version 1, Jan. 24, 2013, 6 pages.
ATI AL-6XN® Alloy (UNS N08367), ATI Allegheny Ludlum, 2010, 59 pages.
ATI 800™/ATI 800H™/ATI 800AT™ ATI Technical Data Sheet, Nickel-base Alloys (UNS N08800/N08810/N08811), 2012 Allegheny Technologies Incorporated, Version 1, Mar. 9, 2012, 7 pages.
ATI 825™ Technical Data Sheet, Nickel-base Alloy (UNS N08825), 2013 Allegheny Technologies Incorporated, Version 2, Mar. 8, 2013, 5 pages.
ATI 625™ Alloy Technical Data Sheet, High Strength Nickel-base Alloy (UNS N06625), Allegheny Technologies Incorporated, Version 1, Mar. 4, 2012, 3 pages.
ATI 600™ Technical Data Sheet, Nickel-base Alloy (UNS N06600), 2012 Allegheny Technologies Incorporated, Version 1, Mar. 19, 2012, 5 pages.
Bar definition, ASM Materials Engineering Dictionary, J.R. Davis Ed., ASM International, Materials Park, OH (1992) p. 32.
Billet definition, ASM Materials Engineering Dictionary, J.R. Davis Ed., ASM International, Materials Park, OH (1992) p. 40.
Cogging definition, ASM Materials Engineering Dictionary, J.R. Davis Ed., ASM International, Materials Park, OH (1992) p. 79.
Open die press forging definition, ASM Materials Engineering Dictionary, J.R. Davis Ed., ASM International, Materials Park, OH (1992) pp. 298 and 343.
Thermomechanical working definition, ASM Materials Engineering Dictionary, J.R. Davis Ed., ASM International, Materials Park, OH (1992) p. 480.
Ductility definition, ASM Materials Engineering Dictionary, J.R. Davis Ed., ASM International, Materials Park, OH (1992) p. 131.
AFML-TR-76-80 Development of Titanium Alloy Casting Technology, Aug. 1976, 5 pages.
Valiev et al., "Nanostructured materials produced by sever plastic deformation", Moscow, LOGOS, 2000.
Li et al., "The optimal determination of forging process parameters for Ti—6.5Al—3.5Mo—1.5Zr—0.3Si alloy with thick lamellar microstructure in two phase field based on P-map", Journal of Materials Processing Technology, vol. 210, Issue 2, Jan. 19, 2010, pp. 370-377.
Buijk, A., "Open-Die Forging Simulation", Forge Magazine, Dec. 1, 2013, 5 pages.
Herring, D., "Grain Size and Its Influence on Materials Properties", IndustrialHeating.com, Aug. 2005, pp. 20 and 22.
INCONEL® alloy 600, Special Metals Corporation, www.specialmetals.com, Sep. 2008, 16 pages.
Yaylaci et al., "Cold Working & Hot Working & Annealing", http://yunus.hacettepe.edu.tr/~selis/teaching/WEBkmu479/Ppt/kmu479Presentations2010/Cold_Hot_Working_Annealing.pdf, 2010, 41 pages.
Superaustenitic, http://www.atimetals.com/products/Pages/superaustenitic.aspx, Nov. 9, 2015, 3 pages.
French, D., "Austenitic Stainless Steel", The National Board of Boiler and Pressure Vessel Inspectors Bulletin, 1992, 3 pages.
Acom Magazine, outokumpu, NACE International, Feb. 2013, 16 pages.

(56) References Cited

OTHER PUBLICATIONS

ATI A286™ Iron Based Superalloy (UNS S66286) Technical Data Sheet, Allegheny Technologies Incorporated, Version 1, Apr. 17, 2012, 9 pages.
ATI A286™ (UNS S66286) Technical Data Sheet, Allegheny Technologies Incorporated, Version 1, Mar. 14, 2012, 3 pages.
Corrosion-Resistant Titanium, Technical Data Sheet, Allegheny Technologies Incorporated, Version 1, Feb. 29, 2012, 5 pages.
ATI 3-2.5™ Titanium (Ti Grade 9) Technical Data Sheet, ATI Wah Chang, 2010, 4 pages.
Grade 9 Ti 3Al 2.5V Alloy (UNS R56320), Jul. 30, 2013, http://www.azom.com/article.aspx?ArticleID=9337, 3 pages.
ATI Ti—6Al—4V, Grade 5, Titanium Alloy (UNS R56400) Technical Data Sheet, Allegheny Technologies Incorporated, Version 1, Jan. 31, 2012, 4 pages.
Panin et al., "Low-cost Titanium Alloys for Titanium-Polymer Layered Composites", 29th Congress of the International Council of the Aeronautical Sciences, St. Petersburg, Russia, Sep. 7, 2014, 4 pages.
Grade Ti—4.5Al—3V—2Mo—2Fe Alloy, Jul. 9, 2013, http://www.azom.com/article.aspx?ArticleID=9448, 2 pages.
Garside et al., "Mission Critical Metallics® Recent Developments in High-Strength Titanium Fasteners for Aerospace Applications", ATI, 2013, 21 pages.
Foltz et al., "Recent Developments in High-Strength Titanium Fasteners for Aerospace Applications", ATI, Oct. 22, 2014, 17 pages.
Kosaka et al., "Superplastic Forming Properties of TIMETAL® 54M", Henderson Technical Laboratory, Titanium Metals Corporation, ITA, Oct. 2010, Orlando, Florida, 18 pages.
Markovsky, P. E., "Preparation and properties of ultrafine (submicron) structure titanium alloys", Materials Science and Engineering, 1995, A203, 4 pages.
ATI Datalloy HP™ Alloy, UNS N08830, Technical Data Sheet Version 1, Apr. 14, 2015, 8 pages.
ATI Datalloy 2® Alloy, Technical Data Sheet, Version 1, Feb. 20, 2014, 6 pages.
Handa, Sukhdeep Singh, "Precipitation of Carbides in a Ni-based Superalloy", Degree Project for Master of Science with Specialization in Manufacturing Department of Engineering Science, University West, Jun. 30, 2014, 42 pages.
Titanium Alloy Guide, RMI Titanium Company, Jan. 2000, 45 pages.
Wanhill et al, "Chapter 2, Metallurgy and Microstructure", Fatigue of Beta Processed and Beta Heat-treated Titanium Alloys, SpringerBriefs in Applied Sciences and Technology, 2012, pp. 5-10.
Heat Treating of Titanium and Titanium Alloys, http://www.totalmateria.com/Article97.htm, Apr. 2004, 5 pages.
Grade 6Al 2Sn 4Zr 6Mo Titanium Alloy (UNS R56260), AZoM, http://www.azom.com/article.aspx?ArticleID=9305, Jun. 20, 2013, 4 pages.
Gammon et al., "Metallography and Microstructures of Titanium and Its Alloys", ASM Handbook, vol. 9: Metallography and Microstructures, ASM International, 2004, pp. 899-917.
Rui-gang Deng, et al. "Effects of Forging Process and Following Heat Treatment on Microstructure and Mechanical Properties of TC11 Titanium Alloy," Materials for Mechanical Engineering, vol. 35. No. 11, Nov. 2011, 5 pages. (English abstract included).
Srinivasan et al., "Rolling of Plates and Sheets from As-Cast Ti—6Al—4V-0.1 B", Journal of Materials Engineering and Performance, vol. 18.4, Jun. 2009, pp. 390-398.
Gil et al., "Formation of alpha-Widmanstatten structure: effects of grain size and cooling rate on the Widmanstatten morphologies and on the mechanical properties in Ti6Al4V alloy", Journal of Alloys and Compounds, 329, 2001, pp. 142-152.
Enayati et al., "Effects of temperature and effective strain on the flow behavior of Ti—6Al—4V", Journal of the Franklin Institute, 348, 2011, pp. 2813-2822.
Longxian et al., "Wear-Resistant Coating and Performance Titanium and Its Alloy, and properties thereof", Northeastern University Press, Dec. 2006, pp. 26-28, 33.
"Acceleration and Improvement for Heat Treating Workers," Quick Start and Improvement for Heat Treatment. ed. Yang Man, China Machine Press, Apr. 2008, pp. 265-266.
Forging Machinery, Dies, Processes, Metals Handbook Desk Edition, ASM International, 198, pp. 839-863.
Smith, et al. "Types of Heat-Treating Furnaces," Heat Treating, ASM Handbook, ASM International, 1991, vol. 4, p. 465-474.
Concise Explanation for Third Party Preissuance submission under Rule 1.290 filed in U.S. Appl. No. 15/678,527 on Jun. 5, 2018.
Guidelines for PWR Steam Generator Tubing Specifications and Repair, Electric Power Research Institute, Apr. 14, 1999, vol. 2, Revision 1, 74 pages. (accessed at https://www.epri.com/#/pages/product/TR-016743-V2R1/).
Materials Reliability Program: Guidelines for Thermally Treated Alloy 690 Pressure Vessel Nozzels, (MRP-241), Electric Power Research Institute, Jul. 25, 2008, 51 pages. (accessed at https://www.epri.com/#/pages/product/1015007/).
Microstructure Etching and Carbon Analysis Techniques, Electric Power Research Institute, May 1, 1990, 355 pages. (accessed at https://www.epri.com/#/pages/product/NP-6720-SD/).
Frodigh, John, "Some Factors Affecting the Appearance of the Microstructure in Alloy 690", Proceedings of the Eighth International Symposium on Environmental Degradation of Materials in Nuclear Power Systems—Water Reactors, American Nuclear Society, Inc., vol. 1, Aug. 10, 1997, 12 pages.
Kajimura et al., "Corrosion Resistance of TT Alloy 690 Manufactured by Various Melting Processes in High Temperature NaOH Solution", Proceedings of the Eighth International Symposium on Environmental Degradation of Materials in Nuclear Power Systems—Water Reactors, American Nuclear Society, Inc., vol. 1, Aug. 10, 1997, pp. 149-156.
The Japan Society for Heat Treatment, Introduction of Heat Treatment, Japan, Minoru, Kanal, Jan. 10, 1974, p. 150.
Angeliu et al, "Behavior of Grain Boundary Chemistry and Precipitates upon Thermal Treatment of Controlled Purity Alloy 690", Metallurgical Transactions A, vol. 21A, Aug. 1990, pp. 2097-2107.
Park et al., "Effect of heat treatment on fatigue crack growth rate of Inconel 890 and Inconel 600", Journal of Nuclear Materials, 231, 1996, pp. 204-212.
Louthan, M.R., "Optical Metallography", ASM Handbook, vol. 10, Materials Characterizations, 1986, pp. 299-308.
Kolachev B.A. et al., Titanium Alloys of Different Countries, Moscow, VILS, 2000, pp. 15-16.
High Strength Non-Magnetic Stainless Steel for Oil Drilling DNM series, Electric Steel Making, Daido Steel Co., Ltd., Japan, Jul. 27, 2012, vol. 83(1), pp. 75-76.
Wu, Quanxing, "High Strength a-β Titanium Alloy Capable of Producing Coils," Rare Metals Letters, Nov. 28, 2002, No. 11, pp. 19-20.
Hui-qin, Chen et al., "Characterization of Hot Deformation Microstructures of Alpha-Beta Titanium Alloy With Equiaxed Structure," Transactions of Nonferrous Metals Society of China, Mar. 15, 2012, vol. 22, No. 3, pp. 503-509.
Titanium Alloy Ti1023 Ti—10V—2Fe—3Al datasheet, Aubert &Duval accessed from chrome-extension://efaidnbmnnnibpcajpcglclefindmkaj/https://www.aubertduval.com/wp-media/uploads/sites/2/2017/06/Ti1023_GB-1.pdf, 2 pages, 2023.
Titanium Ti—4.5Al—5Mo—1.5Cr (Corona 5) datasheet, accessed from https://www.matweb.com, 2 pages, 2023, MatWeb, LLC.
ATI Ti—5Al—-2Sn—2Zr—4Cr—4Mo Alloy Technical Datasheet (UNS R58650) ATI 17™, Version 1, Dec. 20, 2011, Allegheny Technologies Incorporated, 3 pages.
Crossley et al., "Cast Transage 175 Titanium Alloy for Durability Critical Structural Components", Journal of Aircraft, vol. 20, No. 1, Jan. 1983, pp. 66-69.
Inagaki et al., "Application and Features of Titanium for the Aerospace Industry", Nippon Steel & Sumitomo Metal Technical Report, No. 106, Jul. 2014, pp. 22-27.
Nyakana, "Quick reference guide for beta titanium alloys in the 00s", JMEPEG, vol. 14, 2015, pp. 799-811.

(56) References Cited

OTHER PUBLICATIONS

Cotton et al., "State of the Art in Beta Titanium Alloys for Airframe Applications", JOM, vol. 67, No. 8, 2015, pp. 1281-1303.
Lütjering et al., Titanium, 2nd edition, Springer, 2007, pp. 264-269.
Materials Properties Handbook: Titanium Alloys, eds. Boyer et al., Materials Park, Ohio, ASM International, 1994, 13 pages.
Kansal et al., "Microstructural Banding in Thermally and Mechanically Processed Titanium 6242", Journal of Material Engineering and Performance, Springer Verlag, New York, US, vol. 1, No. 3, Jun. 1, 1992, pp. 393-398.
Kitashima et al., "Microstructure and Creep Properties of Silicon- and/or Germanium-Bearing Near-[alpha] Titanium Alloys", Materials Science Forum, vol. 879, Nov. 15, 2016, pp. 2324-2329.
"Special Alloys and Forging Thereof," China Forging Association, pp. 119-122, National Defense Industry Press, Oct. 31, 2009.
"Metal Materials Science," Tang Daiming et al., pp. 251-252, Southwest Jiaotong University Press, Jun. 30, 2014.
"Engineering Materials and Metal Thermal Processing Basis," Jin Nanwei, p. 185, Aviation Industry Press, Jun. 30, 1995.
"Non-ferrous Metal Materials Science," Miao Qiang et al., p. 139, Northwestem Polytechnical University Press, Aug. 31, 2016.
Shipsha, V.G.,Titanium and Titanium Alloys, The Wayback Machine—https://web.archive.org/web/20180505165817/http://www.naukaspb.ru:80/spravochniki/Demo%20Metall/3_17.htm, accessed http://www.naukaspb.ru/spravochniki/Demo%20Metall/3_17.htm, May 5, 2018, 27 pages.
Effect of impurities on titanium alloys, accessed at https://supersplav.ru/blog/2017/05/23/vliyanie-prim+A14esei-na-titanovye-splavy/, May 23, 2017, 8 pages.
"Engineering Materials", Machinery Industry Press, edited by Zhan Wu, published Oct. 31, 1997, p. 226.
Murakami, Y., "Phase Transformation and Heat Treatment in Titanium Alloys", Tetsu-to-Hagané (Iron and Steel), Mar. 1, 1987, vol. 73, No. 3, p. 424. (untranslated).
Kitashima et al., "Effect of Germanium and Silicon Additions on the Mechanical Properties of a Near-α Titanium Alloy," Materials Science & Engineering A, Jan. 8, 2014, vol. 597, pp. 212-218.
AMS4986™ Titanium Alloy, Forgings 10V—2Fe—3Al Consumable Electrode Melted, Single-Step Solution Heat Treated and Overaged 160 ksi (1103 MPa) Tensile Strength, SAE International, Revised Apr. 2019, 8 pages.
Xin et al., "Mechanism of V and Cr mechanical properties of Ti40 burn resistant titanium alloy," The Chinese Journal of Nonferrous Metals, Jul. 2008, vol. 18., No. 7, pp. 1216-1222.
Campbell, Flake C., ed., Lightweight materials—Understanding the Basics. Chapter 5: Titanium Alloys, ASM International, 2012, pp. 232-245.
U.S. Appl. No. 18/483,894, filed Oct. 10, 2023.
Prozesky et al., "Hot-deformation behaviour of α+β Ti—Al—V—Fe experimental alloys." AIP Conference Proceedings, vol. 1896, No. 1, AIP Publishing LLC, 2017, 7 pages.

* cited by examiner

TITANIUM ALLOYS

FIELD

The present disclosure relates to titanium alloys, methods of making titanium alloys, and article of manufacture including titanium alloys.

BACKGROUND

Existing titanium alloys used in structural applications requiring high strength and toughness include, for example, Ti-6Al-4V alloy (UNS R56400, "Ti-64") and Ti-5Al-2Sn-2Zr-4Mo-4Cr alloy (UNS R58650, "Ti-17"). Such alloys can exhibit advantageous toughness along with high tensile properties (yield strength, ultimate tensile strength, and ductility) at room temperature. Ti-17 alloy, for example, exhibits a favorable combination of fracture toughness (about 55.5 ksi√in) and desirable YS and UTS of 161 ksi and 157 ksi, respectively, at room temperature. Developing a titanium alloy exhibiting improved toughness characteristics while maintaining desirable tensile properties presents significant challenges.

SUMMARY

A non-limiting aspect according to the present disclosure is directed to a titanium alloy comprising, in weight percentages based on total alloy weight: 3.5 to 4.5 aluminum; 1.0 to less than 3.0 tin; 1.0 to 3.0 zirconium; 2.0 to 5.5 molybdenum; 2.0 to 4.25 chromium; 0.01 to 0.03 silicon; titanium; and impurities; and wherein an aluminum equivalent value of the titanium alloy is 6.0 to 6.9.

A further non-limiting aspect according to the present disclosure is directed to a titanium alloy comprising, in weight percentages based on total alloy weight: 4.2 to 4.4 aluminum; 1.2 to 1.75 tin; 1.2 to 1.75 zirconium; 4.0 to 4.25 molybdenum; 4.0 to 4.25 chromium; 0.02 to 0.03 silicon; 0 to 0.30 iron; 0 to 0.20 oxygen; 0 to 0.5 nitrogen; 0 to 0.0125 hydrogen; 0 to 0.08 carbon; 1.0 to 2.0 vanadium; 0 to less than 0.1 germanium; 0 to 0.1 of each of niobium, tungsten, hafnium, nickel, gallium, antimony, tantalum, manganese, cobalt, and copper; titanium; and impurities; and wherein an aluminum equivalent value of the titanium alloy is 6.1 to 6.9.

Yet another non-limiting aspect according to the present disclosure is directed to a titanium alloy comprising, in weight percentages based on total alloy weight: 3.65 to 4.4 aluminum; 1.2 to 2.5 tin; 1.2 to 2.2 zirconium; 3.0 to 4.25 molybdenum; 3.0 to 4.25 chromium; 0.02 to 0.03 silicon; 0 to 0.30 iron; 0 to 0.20 oxygen; 0 to 0.5 nitrogen; 0 to 0.0125 hydrogen; 0 to 0.08 carbon; 0 to 2.0 vanadium; 0 to less than 0.1 germanium; 0 to 0.1 of each of niobium, tungsten, hafnium, nickel, gallium, antimony, tantalum, manganese, cobalt, and copper; titanium; and impurities. An aluminum equivalent value of the titanium alloy is 6.1 to 6.5, and a molybdenum equivalent value of the titanium alloy is 4.8 to 10.9. The titanium alloy exhibits a yield strength of at least 137 ksi, an ultimate tensile strength of at least 148 ksi, and a fracture toughness of at least 85 ksi√(in).

Yet a further non-limiting aspect according to the present disclosure is directed to a method for making a titanium alloy. The method comprises solution treating the titanium alloy by a process including heating the titanium alloy at 800° C. to 860° C. for 1 hour to 8 hours, and subsequently cooling the titanium alloy to ambient temperature at a rate depending on a cross-sectional thickness of the titanium alloy. Subsequent to the cooling, the titanium alloy is aged by a process comprising heating the titanium alloy at 480° C. to 700° C. for 4 hours to 16 hours, and then air cooling the aged alloy. In certain embodiments, the titanium alloy comprises, in weight percentages based on total alloy weight: 3.5 to 4.5 aluminum; 1.0 to less than 3.0 tin; 1.0 to 3.0 zirconium; 2.0 to 5.5 molybdenum; 2.0 to 4.25 chromium; 0.01 to 0.03 silicon; titanium; and impurities; and wherein an aluminum equivalent value of the titanium alloy is 6.0 to 6.9.

An additional non-limiting aspect according to the present disclosure is directed to an article of manufacture comprising a titanium alloy. In certain embodiments, the titanium alloy comprises, in weight percentages based on total alloy weight: 3.5 to 4.5 aluminum; 1.0 to less than 3.0 tin; 1.0 to 3.0 zirconium; 2.0 to 5.5 molybdenum; 2.0 to 4.25 chromium; 0.01 to 0.03 silicon; titanium; and impurities; and wherein an aluminum equivalent value of the titanium alloy is 6.0 to 6.9.

It is understood that the inventions disclosed and described in this specification are not limited to the aspects summarized in this Summary. The reader will appreciate the foregoing details, as well as others, upon considering the following detailed description of various non-limiting and non-exhaustive aspects according to this specification.

BRIEF DESCRIPTION OF THE FIGURES

The features and advantages of examples presented herein, and the manner of attaining them, will become more apparent, and the examples will be better understood, by reference to the following description taken in conjunction with the accompanying figures, wherein.

Figure 1:
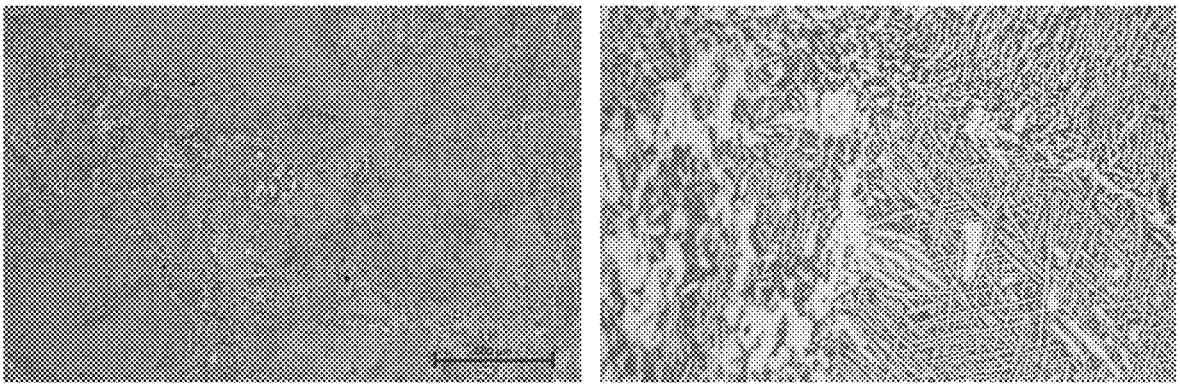
FIG. 1 includes electron microscope images of the alloy of Example Composition 1 after thermomechanical working and solution treating and aging, and wherein a laths appear as light colored elongated shapes in a dark β matrix as a result of the application of a standard nitric/hydrofluoric etchant.

The examples set out herein illustrate certain embodiments, in one form, and such examples are not to be construed as limiting the scope of the appended claims in any manner.

DETAILED DESCRIPTION OF CERTAIN NON-LIMITING EMBODIMENTS

Various embodiments are described and illustrated herein to provide an overall understanding of the disclosed titanium alloys, methods, and articles of manufacture. The various embodiments described and illustrated herein are non-limiting and non-exhaustive. Thus, an invention is not limited by the description of the various non-limiting and non-exhaustive embodiments disclosed herein. Rather, the invention is defined solely by the claims.

The features and characteristics illustrated and/or described in connection with various embodiments may be combined with the features and characteristics of other embodiments. Such modifications and variations are intended to be included within the scope of this specification. As such, the claims may be amended to recite any features or characteristics expressly or inherently described in, or otherwise expressly or inherently supported by, this specification. Further, the applicant reserves the right to amend the claims to affirmatively disclaim features or characteristics that may be present in the prior art.

The various embodiments disclosed and described in this specification can comprise, consist of, or consist essentially of the features and characteristics as variously described herein. For example, reference herein to a titanium alloy "comprising" a particular elemental composition is intended to also encompass alloys "consisting essentially of" or "consisting of" the stated composition. It will be understood that titanium alloy compositions described herein that "comprise", "consist of", or "consist essentially of" a particular composition also may include impurities.

All elemental concentrations provided herein for an alloy composition are weight percentages based on total weight of the particular alloy composition, unless otherwise indicated herein.

The high temperature performance and fracture toughness of titanium alloys can be dependent on microstructural features of the titanium alloys. Titanium has two allotropic forms: a beta ("β")-phase, which has a body centered cubic ("bcc") crystal structure; and an alpha ("α")-phase, which has a hexagonal close packed ("hcp") crystal structure. One group of titanium alloys widely used in a variety of applications is the α/β titanium alloy. In α/β titanium alloys, the distribution and size of the alloy's primary α particles can directly impact high temperature performance and fracture toughness.

It can be challenging to increase a material's toughness while also maintaining or improving tensile properties. Enhancing the fracture toughness of a titanium alloy while maintaining and/or increasing alloy tensile properties, however, can enable novel part designs exhibiting higher damage tolerance. Embodiments of the titanium alloy provided herein can exhibit enhanced fracture toughness relative to certain existing titanium alloys, while also maintaining acceptable tensile properties.

The present inventors determined that enhancing fracture toughness and tensile strength of titanium alloys can be achieved by controlling the chemistry and/or microstructure of the titanium alloys. The titanium alloy provided herein can be an α/β titanium alloy, which can include a balance of α and β stabilizers and a desirable aluminum equivalent value ($Al_{eq}$) and/or molybdenum equivalent value ($Mo_{eq}$). The composition of a titanium alloy according to the present disclosure can inhibit formation of problematic intermetallic phases (e.g., $Ti_3Al$, silicides), which can enhance the microstructure formed in the alloy. Fracture toughness and tensile strength properties of the titanium alloy according to the present disclosure can be enhanced by: providing reduced aluminum content relative to certain titanium alloys; including additions of tin and zirconium, for example, to provide a desirable aluminum equivalent value ($Al_{eq}$); and introducing β phase stabilizing elements such as, for example, vanadium, chromium, molybdenum, iron, niobium, nickel, manganese, tantalum, and/or cobalt. Embodiments of the titanium alloy according to the present disclosure can exhibit solid solution strengthening while balancing the effect of shear modulus mismatch between solute and solvent atoms in a given phase.

Certain non-limiting embodiments of a titanium alloy according to the present disclosure comprise, in weight percentages based on total weight of the titanium alloy: 3.5 to 4.5 aluminum; 1.0 to less than 3.0 tin; 1.0 to 3.0 zirconium; 2.0 to 5.5 molybdenum; 2.0 to 4.25 chromium; 0.01 to 0.03 silicon; titanium; and impurities; and wherein an aluminum equivalent value of the titanium alloy is 6.0 to 6.9.

Other non-limiting embodiments of a titanium alloy according to the present disclosure comprise, in weight percentages based on total weight of the titanium alloy: 3.5 to 4.5 aluminum; 1.0 to less than 3.0 tin; 1.0 to 3.0 zirconium; 2.0 to 5.5 molybdenum; 2.0 to 4.25 chromium; 0.01 to 0.03 silicon; 0 to 0.30 iron; 0 to 0.20 oxygen; 0 to 0.5 nitrogen; 0 to 0.0125 hydrogen; 0 to 0.08 carbon; 0 to 2 vanadium; 0 to less than 0.1 germanium; 0 to 0.1 of each of niobium, tungsten, hafnium, nickel, gallium, antimony, tantalum, manganese, cobalt, and copper; titanium; and impurities.

Other non-limiting embodiments of a titanium alloy according to the present disclosure comprise, in weight percentages based on total weight of the titanium alloy: 3.65 to 4.4 aluminum; 1.2 to 2.5 tin; 1.2 to 2.2 zirconium; 3.0 to 4.25 molybdenum; 3.0 to 4.25 chromium; 0.02 to 0.03 silicon; 0 to 0.30 iron; 0 to 0.20 oxygen; 0 to 0.5 nitrogen; 0 to 0.0125 hydrogen; 0 to 0.08 carbon; 0 to 2 vanadium; 0 to less than 0.1 germanium; 0 to 0.1 of each of niobium, tungsten, hafnium, nickel, gallium, antimony, tantalum, manganese, cobalt, and copper; titanium; and impurities.

Other non-limiting embodiments of a titanium alloy according to the present disclosure comprise, in weight percentages based on total weight of the titanium alloy: 4.2 to 4.4 aluminum; 1.2 to 1.75 tin; 1.2 to 1.75 zirconium; 4.0 to 4.25 molybdenum; 4.0 to 4.25 chromium; 0.02 to 0.03 silicon; 0 to 0.30 iron; 0 to 0.20 oxygen; 0 to 0.5 nitrogen; 0 to 0.0125 hydrogen; 0 to 0.08 carbon; 1 to 2 vanadium; 0 to less than 0.1 germanium; 0 to 0.1 of each of niobium, tungsten, hafnium, nickel, gallium, antimony, tantalum, manganese, cobalt, and copper; titanium; and impurities; and wherein an aluminum equivalent value of the titanium alloy is 6.1 to 6.9.

Other non-limiting embodiments of a titanium alloy according to the present disclosure comprise, in weight percentages based on total weight of the titanium alloy: 3.65 to 4.4 aluminum; 1.2 to 2.5 tin; 1.2 to 2.2 zirconium; 3.0 to 4.25 molybdenum; 3.0 to 4.25 chromium; 0.02 to 0.03 silicon; 0 to 0.30 iron; 0 to 0.20 oxygen; 0 to 0.5 nitrogen; 0 to 0.0125 hydrogen; 0 to 0.08 carbon; 0 to 2 vanadium; 0 to less than 0.1 germanium; 0 to 0.1 of each of niobium, tungsten, hafnium, nickel, gallium, antimony, tantalum, manganese, cobalt, and copper; titanium; and impurities.

In various embodiments of a titanium alloy according to the present disclosure, an aluminum equivalent value can be in a range of 6.1 to 6.9 or 6.1 to 6.5, and a molybdenum equivalent value can be in a range of 4.8 to 10.9. In various embodiments, a titanium alloy according to the present disclosure can exhibit a yield strength of at least 137 ksi, an ultimate tensile strength of at least 148 ksi, and a fracture toughness of at least 85 ksi√(in).

Aluminum may be included in a titanium alloy according to the present disclosure to increase the alloy's alpha content and/or increase strength. However, aluminum content of the present alloy can be limited to a level that will inhibit formation of intermetallic phases (for example, $Ti_3Al$ phase)

which can reduce ductility and/or toughness properties of the alloy. Certain non-limiting embodiments of a titanium alloy according to the present disclosure can comprise, in weight percent based on total weight of the titanium alloy, 3.5% to 4.5% aluminum, such as, for example, 3.6% to 4.5%, 3.6% to 4.4%, 3.65% to 4.4%, 3.8% to 4.4%, 4.0% to 4.4%, or 4.2% to 4.4% aluminum.

Tin may be included in a titanium alloy according to the present disclosure to increase alpha content, increase strength, and/or adjust the aluminum equivalent value ($Al_{eq}$) of the alloy. Certain non-limiting embodiments of a titanium alloy according to the present disclosure can comprise, in weight percent based on total weight of the titanium alloy, 1.0% to less than 3.0% tin, such as, for example, 1.0% to 2.9%, 1.0% to 2.8%, 1.0% to 2.5%, 1.2% to 2.5%, 1.5% to 2.5%, 1.5% to 2.3%, or 1.4% to 1.7% tin.

Molybdenum, chromium, and vanadium are primary β strengtheners and can be included in embodiments of an alloy according to the present disclosure to enhance tensile strength and/or fracture toughness. Chromium, for example, can be effective to strengthen the β phase due to a mismatch between shear moduli in chromium compared with titanium. Certain non-limiting embodiments of a titanium alloy according to the present disclosure can comprise, in weight percent based on total weight of the titanium alloy, 2.0% to 4.25% chromium, such as, for example, 3.0% to 4.25%, 3.5% to 4.25%, or 4.0% to 4.25% chromium.

Molybdenum may be included in a titanium alloy according to the present disclosure to increase β content and/or increase tensile strength. Certain non-limiting embodiments of a titanium alloy according to the present disclosure can comprise, in weight percent based on total weight of the titanium alloy, 2.0% to 5.5% molybdenum, such as, for example, 2.0% to 5%, 2.0% to 4.5%, 2.0% to 4.25%, 3.0% to 4.5%, 3.0% to 4.5%, 3.0% to 4.25%, 3.5% to 4.5%, 4.0% to 4.5%, or 4.0% to 4.4% molybdenum.

Certain non-limiting embodiments of a titanium alloy according to the present disclosure can comprise, in weight percent based on total weight of the titanium alloy, 0% to 2% vanadium, such as, for example, 0.5% to 2%, 1% to 2%, or 1.4% to 1.8% vanadium.

Zirconium may be included in a titanium alloy according to the present disclosure to increase a content, provide increased strength, and/or adjust the aluminum equivalent value ($Al_{eq}$) of the alloy. Certain non-limiting embodiments of a titanium alloy according to the present disclosure can comprise, in weight percent based on total weight of the titanium alloy, 1.0% to 3.0% zirconium, such as, for example, 1% to 2.5%, 1% to 2%, 1.5% to 2.5%, 1.5% to 2%, or 1.4% to 1.9% zirconium.

Silicon content of embodiments of a titanium alloy according to the present disclosure may be limited to inhibit formation of a network of silicides on the β grain boundaries, which can lower ductility and toughness. Certain non-limiting embodiments of a titanium alloy according to the present disclosure can comprise, in weight percent based on total weight of the titanium alloy, 0.01% to 0.03% silicon, such as, for example, 0.01% to 0.025%, 0.014% to 0.03%, 0.02% to 0.03%, or 0.14% to 0.025% silicon.

Germanium content of embodiments of a titanium alloy according to the present disclosure may be limited to inhibit formation of germanium-containing intermetallic precipitates. For example, in certain embodiments of the present alloy germanium may not be intentionally added to the titanium alloys and may be absent or present only as an impurity. If present, germanium content in the present alloy is less than 0.1% by weight. Certain non-limiting embodiments of a titanium alloy according to the present disclosure can comprise, in weight percent based on total weight of the titanium alloy, 0 to less than 0.1% germanium, such as, for example, 0 to 0.09%, 0 to 0.08%, 0 to 0.05%, 0 to 0.02%, or 0 to 0.01% germanium.

Certain non-limiting embodiments of a titanium alloy according to the present disclosure can comprise one or more other elements, such as, for example, niobium, tungsten, hafnium, nickel, gallium, antimony, tantalum, manganese, and cobalt. Certain alloy embodiments according to the present disclosure may comprise 0 to 0.1% of each of niobium, tungsten, hafnium, nickel, gallium, antimony, tantalum, manganese, and cobalt.

Titanium alloys according to the present disclosure may include impurities. Impurities may be present in the alloys as a result of, for example, impurities in the starting materials (e.g., recycled scrap materials) and/or processing of the alloy during production. In various non-limiting embodiments of titanium alloys according to the present disclosure, one or more of the following elements may be present as impurities: sulfur, phosphorus, calcium, bismuth, lead, antimony, selenium, arsenic, silver, tellurium, thallium, zinc, ruthenium, platinum, rhodium, palladium, osmium, iridium, gold, fluorine, and chlorine. Impurity elements, if present, typically are present in individual concentrations no greater than 0.1 weight percent, and the total content of such impurities typically is no greater than 0.5 weight percent, all based on total alloy weight. It will be understood that the foregoing list of impurity elements is not necessarily inclusive of all elements that might be present as impurities in an alloy according to the present disclosure.

Certain non-limiting embodiments of a titanium alloy according to the present disclosure may not require extra low interstitials ("ELI") while exhibiting enhanced fracture toughness. Thus, certain embodiments of a titanium alloy according to the present disclosure can require less manufacturing controls during processing and/or may be made from lower purity starting materials. Certain non-limiting embodiments of a titanium alloy according to the present disclosure can comprise, in weight percent based on total alloy weight, 0 to 0.30% iron, 0 to 0.20% oxygen, 0 to 0.5% nitrogen, 0 to 0.0125% hydrogen, and/or 0 to 0.08% carbon. For example, certain non-limiting embodiments of a titanium alloy according to the present disclosure can comprise greater than 0.13% oxygen while still exhibiting enhanced fracture toughness relative to certain existing titanium alloys.

The appropriate balance between aluminum, zirconium, and tin in certain embodiments of an alloy according to the present disclosure can be determined by the aluminum equivalent value ($Al_{eq}$). $Al_{eq}$ is calculated by the following equation, wherein [Al], [Zr], [Sn], [O], [N], and [C] refer to the weight percentage of the respective element in the titanium alloy:

$$Al_{eq} = [Al] + \frac{[Zr]}{6} + \frac{[Sn]}{3} + 10[O] + 20[N] + \frac{2[C]}{3}$$

Certain non-limiting embodiments of a titanium alloy according to the present disclosure have an aluminum equivalent value ($Al_{eq}$) in a range of 6.0 to 6.9, such as, for example, 6.1 to 6.9, 6.1 to 6.5, 6.0 to 6.4, or 6.1 to 6.4.

The appropriate balance between molybdenum, chromium, and vanadium, and optionally cobalt and niobium in certain embodiments of an alloy according to the present disclosure can be determined by the molybdenum equivalent value ($Mo_{eq}$). $Mo_{eq}$ is calculated by the following equation, wherein [Mo], [Ta], [Nb], [W], [V], [Cr], [Ni], [Mn], [Co], and [Fe] refer to the weight percentage of the respective element in the titanium alloy.

$$Mo_{eq} = [Mo] + \frac{[Ta]}{5} + \frac{[Nb]}{3.6} + \frac{[W]}{2.5} + \frac{[V]}{1.5} + 1.25[Cr] + 1.25[Ni] + 1.7[Mn] + 1.7[Co] + 2.5[Fe]$$

Certain non-limiting embodiments of a titanium alloy according to the present disclosure have a molybdenum equivalent value ($Mo_{eq}$) in a range of 4.8 to 10.9, such as, for example, 7.0 to 10.9, 8.0 to 10.9, 9.0 to 10.9, or 10.0 to 10.9.

The microstructure of various embodiments of a titanium alloy according to the present disclosure provides an advantageous combination of yield strength, ultimate tensile strength, and fracture toughness characteristics. The microstructure can be characterized by the presence of long primary α-laths and little to no grain boundary α-Ti precipitation.

In certain non-limiting embodiments, a titanium alloy according to the present disclosure exhibits a yield strength of at least 137 ksi, such as, for example, at least 140 ksi, at least 141 ksi, at least 145 ksi, at least 146 ksi, or at least 148 ksi. In certain non-limiting embodiments, a titanium alloy according to the present disclosure can exhibit an ultimate tensile strength of at least 148 ksi, such as, for example, at least 150 ksi, at least 155 ksi, or at least 156 ksi. The yield strength and ultimate tensile strength can be measured according to ASTM E8/E8M-22. The yield strength and ultimate tensile strength can be measured at room temperature (e.g., 72° F.+/−2° F.).

In certain non-limiting embodiments, a titanium alloy according to the present disclosure can exhibit a fracture toughness of at least 85 ksi√(in), such as, for example, at least at 87 ksi√(in), at least 89 ksi√(in), at least 90 ksi√(in), at least 92 ksi√(in), at least 95 ksi√(in), or at least at least 97 ksi√(in). For example, various embodiments of a titanium alloy according to the present disclosure can exhibit a fracture toughness in a range of 89 ksi√(in) to 100 ksi√(in), such as, for example, 90 ksi√(in) to 100 ksi√(in), or 92 ksi√(in) to 100 ksi√(in). Fracture toughness can be measured according to ASTM E399. The fracture toughness can be measured at room temperature (e.g., 72° F.+/−2° F.).

Embodiments of a titanium alloy according to the present disclosure can be produced by plasma arc melting (PAM), vacuum arc re-melting (VAR), electron beam cold hearth, or a combination thereof to cast the material to form a substantially homogenous ingot.

For example, embodiments of a titanium alloy according to the present disclosure can be produced by PAM, optionally followed by VAR (e.g., PAM+VAR), and casting the material to form a substantially homogenous ingot. The ingot can be thermomechanically worked through forging, rolling, extruding, drawing, swaging, hot isostatic pressing, upsetting, annealing, and/or other hot working techniques to achieve a desired microstructure. For example, the ingot can subject to a sequence including a first β forging step above the β transus temperature of the titanium alloy, an α+β forging step below the β transus temperature (which may induce recrystallization), and a second β forging step above the transus temperature of the titanium alloy.

After thermomechanically working the alloy, in various embodiments the alloy can be heated treated, such as, for example, solution treated and aged. Solutionizing can be performed at, for example, 50° F. to 150° F. below the β transus temperature of the titanium alloy to provide a desired primary alpha volume fraction. Aging can be performed at a temperature lower than the solutionizing temperature to promote fine precipitation of secondary alpha phase. In certain non-limiting embodiments, the titanium alloy can be thermomechanically works and/or heat treated as described in U.S. Pat. No. 10,913,991 or 11,384,413, both of which are hereby incorporated by reference herein. Those having ordinary skill will be able to determine a suitable sequence of steps to cast, thermomechanically work, and heat treat an alloy according to the present disclosure to impart desirable mechanical properties.

For example, an embodiment of a process for making a titanium alloy according to the present disclosure can comprise solution treating the titanium alloy at a temperature in a range of 800° C. to 860° C. for 1 hour to 8 hours. Subsequently, the titanium alloy can be cooled to ambient temperature at a rate depending on a cross-sectional thickness of the titanium alloy (so as to prevent cracking). The titanium alloy can be aged at a temperature in a range of 480° C. to 700° C. for 4 hours to 16 hours and air cooled.

Mill products comprising an alloy according to the present disclosure may include, for example, a foil, a sheet, a plate, a wire, a billet, a bar, a rod, a slab, an ingot, a forging, a casting, and a powder. Those having ordinary skill who consider the present description of the alloy of the invention will be able to determine, without undue experimentation, a suitable sequence of steps to cast, thermomechanically work, heat treat, and further process an alloy according to the present disclosure to provide a mill product of the alloy having desired mechanical properties.

Potential applications for titanium alloys according to the present disclosure are numerous. For example, embodiments of the titanium alloy described herein are advantageously applied in a variety of applications in which fracture toughness is important. Articles of manufacture for which a titanium alloy according to the present disclosure would be particularly advantageous include certain aerospace and aeronautical applications including, for example, jet engine turbine discs and turbofan blades. Those having ordinary skill in the art will be capable of fabricating such parts and other articles of manufacture from alloys according to the present disclosure without the need to provide further description herein. The foregoing examples of possible applications for alloys according to the present disclosure are offered by way of example only and are not exhaustive of all applications in which the present alloy may be applied. Those having ordinary skill, upon considering the present disclosure, may readily identify additional applications for the alloy herein.

EXAMPLES

The following examples are intended to describe certain non-limiting embodiments, without restricting the scope of the present disclosure. Persons having ordinary skill in the art will appreciate that variations of the following examples are possible within the scope of the present disclosure.

Example alloy compositions 1, 2, and 3 according to the present disclosure were prepared by PAM+VAR processing and thermomechanically working into a billet. The billet was solution treated and aged. A chemical analysis of the solution treated and aged billet was performed and the results are shown in Table 1. The literature values for several existing commercially available alloys also are shown in Table 1.

TABLE 1

| Elemental composition (Weight Percentages) | | | | | | | | | | | | | |
|---|---|---|---|---|---|---|---|---|---|---|---|---|---|
| Alloy | Al | V | Fe | Sn | Cr | Zr | Mo | Si | O | Co | Ti | $Al_{Eq}$ | $Mo_{Eq}$ |
| ATI Titan 171 ™ | 5.75 | — | 0.06 | 2.75 | 3.75 | 2.75 | 3.75 | 0.05 | 0.012 | — | Bal. | 7.6 | 9.0 |
| Ti-1023 | 3 | 10 | 2 | — | — | — | — | — | 0.11 | — | Bal. | 4.2 | 11.7 |
| Ti-17 | 5 | — | 0.2 | 2 | 4 | 2 | 4 | — | 0.12 | — | Bal. | 7.2 | 9.5 |
| ATI Titan 27 ™ | 5 | 2.5 | 0.8 | 4 | — | — | — | — | 0.20 | 1 | Bal. | 7.5 | 4.9 |
| Ti-64ELI | 6 | 4 | 0.12 | — | — | — | — | — | 0.1 | — | Bal. | 7.0 | 4.3 |
| Example alloy composition 1 | 4.28 | — | 0.06 | 2.26 | 2.9 | 1.87 | 3.33 | 0.014 | 0.11 | — | Bal. | 6.5 | 7.1 |
| Example alloy composition 2 | 3.69 | — | 0.07 | 1.62 | 2.08 | 1.86 | 2.1 | 0.03 | 0.15 | — | Bal. | 6.5 | 4.8 |
| Example alloy composition 3 | 4.35 | 1.68 | 0.06 | 1.55 | 4.15 | 1.57 | 4.25 | 0.02 | 0.09 | — | Bal. | 6.1 | 10.9 |

*Some impurities below measurable analytical measurements may have been present

Ultimate tensile strength (UTS), yield strength (YS), percent elongation, and fracture toughness of Example alloy compositions 1, 2, and 3 were measured and are shown in Table 2. UTS and YS were measured according to ASTM E8/E8M-22. Fracture toughness was measured according to ASTM E399. Percent elongation was measured according to ASTM E8/E8M-22.

TABLE 2

| Mechanical properties (at 72° F.) | | | | | |
|---|---|---|---|---|---|
| Alloy | Fracture Toughness (ksi√(in)) | UTS (ksi) | 0.2% YS (ksi) | % Elong. | Notes |
| ATI Titan 171 ™ | 52.4 | 177 | 165 | 13 | 1 |
| Ti-1023 | 55 | 160 | 145 | 6 | 2 |
| Ti-17 | 55.5 | 161 | 157 | 6.5 | 3 |
| ATI Titan 27 ™ | 81 | 150 | 140 | 18 | 1 |
| Ti-64ELI | 85 | 130 | 115 | 10 | 4 |
| Example 1 | 89.3 | 158 | 146 | 17 | 1 |
| Example 2 | 92.5 | 155 | 141 | 14 | 1 |
| Example 3 | 97.1 | 156 | 148 | 17 | 1 |

1. Measured.
2. Not Measured; data from SAE AMS 4986F.
3. Not Measured; data from *Materials Properties Handbook Titanium Alloys*, R. Boyer, G. Welsch, E.W. Collings ed., ASM Int., 1994.
4. Not Measured; data from AMS 4905F.

Figure 2:
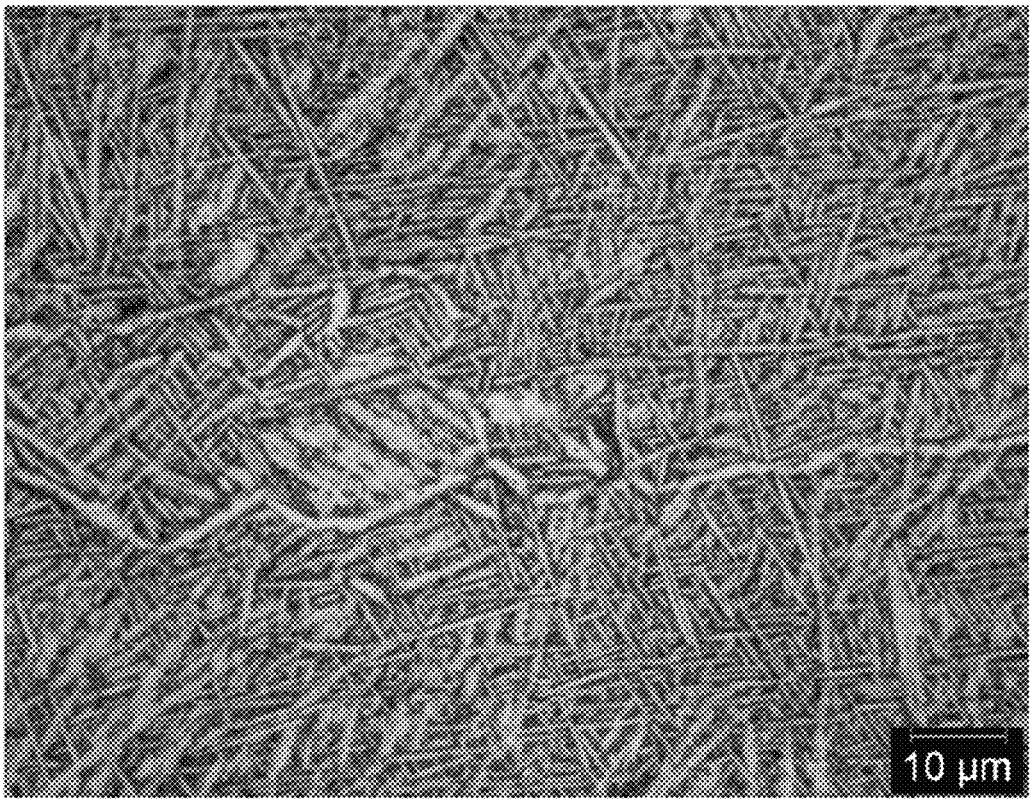
FIG. 2 is an electron microscope image of the alloy of Example Composition 2 after thermomechanical working and solution treating and aging, and wherein a laths appear as light colored elongated shapes in a dark β matrix as a result of the application of a standard nitric/hydrofluoric etchant.
Figure 3:
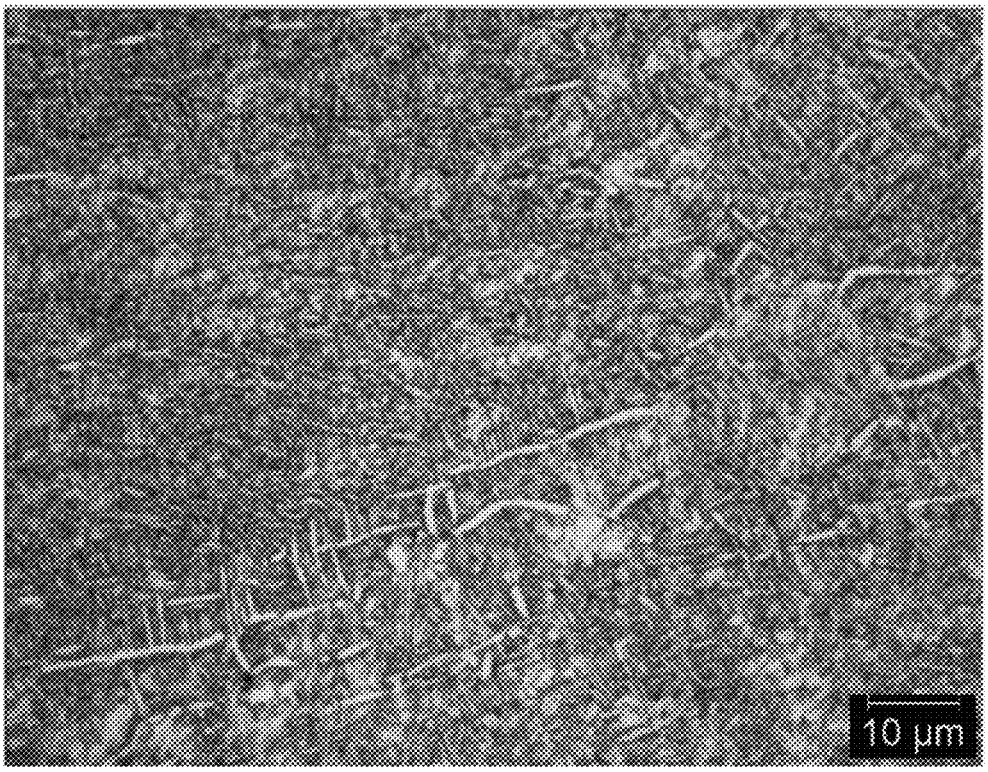
FIG. 3 is an electron microscope image of the alloy of Example Composition 1 after thermomechanical working and solution treating and aging, and wherein a laths appear as light colored elongated shapes in a dark β matrix as a result of the application of a standard nitric/hydrofluoric etchant.

It was observed that example alloy compositions 1, 2, and 3 exhibited an advantageous balance of fracture toughness and tensile properties which may be a result of alloy chemistry and microstructure. Microstructure of example alloy compositions 1, 2, and 3 is shown in the electron microscopy images of prepared samples shown in the attached figures. FIG. 1 includes electron micrographs of example alloy composition 1. FIG. 2 is an electron micrograph of the example alloy composition 2. FIG. 3 is an electron micrograph of the example alloy composition 3. As illustrated in FIGS. 1-3, the microstructures of the alloy samples included long a laths with a large aspect ratio in a "basket weave" or random arrangement, which is a microstructural characteristic indicative of high fracture toughness. Additionally, the microstructures shown in FIGS. 1-3 exhibit an absence of continuous a decoration at β grain boundaries, which the present inventors also believe enhanced the alloys' mechanical properties. Both of the foregoing advantageous microstructural characteristics were exhibited by the example alloy compositions 1, 2, and 3 in a solution treated and aged condition.

It will be understood that the scope of the present disclosure is not necessarily limited to alloys comprising the elemental contents listed in the Examples.

The following numbered clauses are directed to various non-limiting embodiments according to the present disclosure:

Clause 1. A titanium alloy comprising, in percent by weight based on total alloy weight: 3.5 to 4.5 aluminum; 1.0 to less than 3.0 tin; 1.0 to 3.0 zirconium; 2.0 to 5.5 molybdenum; 2.0 to 4.25 chromium; 0.01 to 0.03 silicon; titanium; and impurities; and wherein an aluminum equivalent value of the titanium alloy is 6.0 to 6.9.

Clause 2. The titanium alloy of clause 1, wherein a molybdenum equivalent value of the titanium alloy is 4.8 to 10.9.

Clause 3. The titanium alloy of clause 1, wherein a molybdenum equivalent value of the titanium alloy is 7.0 to 10.9.

Clause 4. The titanium alloy of any of clauses 1-3, wherein an aluminum equivalent value of the titanium alloy is 6.1 to 6.5.

Clause 5. The titanium alloy of any of clauses 1-4 comprising, in weight percent based on total alloy weight: 3.5 to 4.5 aluminum; 1.0 to less than 3.0 tin; 1.0 to 3.0 zirconium; 2.0 to 5.5 molybdenum; 2.0 to 4.25 chromium; 0.01 to 0.03 silicon; 0 to 0.30 iron; 0 to 0.20 oxygen; 0 to 0.5 nitrogen; 0 to 0.0125 hydrogen; 0 to 0.08 carbon; 0 to 2 vanadium; 0 to less than 0.1 germanium; 0 to 0.1 of each of niobium, tungsten, hafnium, nickel, gallium, antimony, tantalum, manganese, cobalt, and copper; titanium; and impurities.

Clause 6. The titanium alloy of any of clauses 1-5 comprising, in percent by weight based on total alloy weight, 3.65 to 4.4 aluminum.

Clause 7. The titanium alloy of any of clauses 1-6 comprising, in percent by weight based on total alloy weight, 4.2 to 4.4 aluminum.

Clause 8. The titanium alloy of any of clauses 1-7 comprising, in percent by weight based on total alloy weight, 0.014 to 0.03 silicon.

Clause 9. The titanium alloy of any of clauses 1-8 comprising, in percent by weight based on total alloy weight, 0.02 to 0.03 silicon.

Clause 10. The titanium alloy of any of clauses 1-9 comprising, in percent by weight based on total alloy weight, 3.0 to 4.25 molybdenum and 3.0 to 4.25 chromium.

Clause 11. The titanium alloy of any of clauses 1-10, wherein the titanium alloy exhibits a yield strength of at least 137 ksi, an ultimate tensile strength of at least 148 ksi, and a fracture toughness of at least 85 ksi√(in).

Clause 12. The titanium alloy of any of clauses 1-11, wherein the titanium alloy exhibits a yield strength of at least 145 ksi, an ultimate tensile strength of at least 155 ksi, and a fracture toughness of at least 89 ksi√(in).

Clause 13. The titanium alloy of clause 1 comprising, in weight percent based on total alloy weight: 3.65 to 4.4 aluminum; 1.2 to 2.5 tin; 1.2 to 2.2 zirconium; 3.0 to 4.25 molybdenum; 3.0 to 4.25 chromium; 0.02 to 0.03 silicon; 0 to 0.30 iron; 0 to 0.20 oxygen; 0 to 0.5 nitrogen; 0 to 0.0125 hydrogen; 0 to 0.08 carbon; 0 to 2 vanadium; 0 to less than 0.1 germanium; 0 to 0.1 of each of niobium, tungsten, hafnium, nickel, gallium, antimony, tantalum, manganese, cobalt, and copper; titanium; and impurities.

Clause 14. The titanium alloy of clause 13, wherein a molybdenum equivalent value of the titanium alloy is 4.8 to 10.9.

Clause 15. The titanium alloy of clause 13, wherein a molybdenum equivalent value of the titanium alloy is 7.0 to 10.9.

Clause 16. The titanium alloy of any of clauses 13-15, wherein an aluminum equivalent value of the titanium alloy is 6.1 to 6.5.

Clause 17. The titanium alloy of any of clauses 13-16, wherein the titanium alloy exhibits a yield strength of at least 137 ksi, an ultimate tensile strength of at least 148 ksi, and a fracture toughness of at least 85 ksi√(in).

Clause 18. The titanium alloy of any of clauses 13-17, wherein the titanium alloy exhibits a yield strength of at least 145 ksi, an ultimate tensile strength of at least 155 ksi, and a fracture toughness of at least 89 ksi√(in).

Clause 19. A titanium alloy comprising, in weight percent based on total alloy weight: 4.2 to 4.4 aluminum; 1.2 to 1.75 tin; 1.2 to 1.75 zirconium; 4.0 to 4.25 molybdenum; 4.0 to 4.25 chromium; 0.02 to 0.03 silicon; 0 to 0.30 iron; 0 to 0.20 oxygen; 0 to 0.5 nitrogen; 0 to 0.0125 hydrogen; 0 to 0.08 carbon; 1.0 to 2.0 vanadium; 0 to less than 0.1 germanium; 0 to 0.1 of each of niobium, tungsten, hafnium, nickel, gallium, antimony, tantalum, manganese, cobalt, and copper; titanium; and impurities; and wherein an aluminum equivalent value of the titanium alloy is 6.1 to 6.9.

Clause 20. A titanium alloy comprising, in weight percent based on total alloy weight: 3.65 to 4.4 aluminum; 1.2 to 2.5 tin; 1.2 to 2.2 zirconium; 3.0 to 4.25 molybdenum; 3.0 to 4.25 chromium; 0.02 to 0.03 silicon; 0 to 0.30 iron; 0 to 0.20 oxygen; 0 to 0.5 nitrogen; 0 to 0.0125 hydrogen; 0 to 0.08 carbon; 0 to 2.0 vanadium; 0 to less than 0.1 germanium; 0 to 0.1 of each of niobium, tungsten, hafnium, nickel, gallium, antimony, tantalum, manganese, cobalt, and copper; titanium; and impurities; wherein an aluminum equivalent value of the titanium alloy is 6.1 to 6.5, a molybdenum equivalent value of the titanium alloy is 4.8 to 10.9, and the alloy exhibits a yield strength of at least 137 ksi, an ultimate tensile strength of at least 148 ksi, and a fracture toughness of at least 85 ksi√(in).

Clause 21. A method of making a titanium alloy, the method comprising: solution treating the titanium alloy at 800° C. to 860° C. for 1 hour to 8 hours; cooling the titanium alloy to ambient temperature; aging the titanium alloy at 480° C. to 700° C. for 4 hours to 16 hours; and air cooling the titanium alloy; wherein the titanium alloy has a composition as recited in any of clauses 1-20.

Clause 22. An article of manufacture comprising the titanium alloy of any of clauses 1-20 or the titanium alloy produced according to claim 21.

Clause 23. The article of manufacture of clause 22, wherein the article of manufacture is selected from the group consisting of a foil, a sheet, a plate, a wire, a billet, a bar, a rod, a slab, an ingot, a forging, a casting, and a powder.

Various non-limiting embodiments are described and illustrated in this specification to provide an overall understanding of the disclosed inventions. It is understood that the various non-limiting embodiments described and illustrated in this specification are non-limiting and non-exhaustive. Thus, the invention is not limited by the description of the various non-limiting and non-exhaustive embodiments disclosed in this specification. Rather, the invention sought to be patented is defined solely by the claims. The features and characteristics illustrated and/or described in connection with various non-limiting embodiments may be combined with the features and characteristics of other non-limiting embodiments. Such modifications and variations are intended to be included within the scope of this specification. As such, the claims may be amended or supplemented to recite any features or characteristics expressly or inherently described in, or otherwise expressly or inherently supported by, this specification. Further, applicant reserves the right to amend the claims to affirmatively disclaim features or characteristics that may be present in the prior art. The various non-limiting embodiments disclosed and described in this specification can comprise, consist of, or consist essentially of the features and characteristics as variously described herein.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

In this specification, other than where otherwise indicated, all numerical parameters are to be understood as being prefaced and modified in all instances by the term "about", in which the numerical parameters possess the inherent variability characteristic of the underlying measurement techniques used to determine the numerical value of the parameter. At the very least, and not as an attempt to limit the application of the doctrine of equivalents to the scope of the claims, each numerical parameter described in the present description should at least be construed in light of the number of reported significant digits and by applying ordinary rounding techniques.

Also, any numerical range recited in this specification is intended to include all sub-ranges of the same numerical precision subsumed within the recited range. For example, a range of "1 to 10" is intended to include all sub-ranges between (and including) the recited minimum value of 1 and the recited maximum value of 10, that is, having a minimum value equal to or greater than 1 and a maximum value equal to or less than 10, such as, for example, 2.4 to 7.6. Any maximum numerical limitation recited in this specification is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such sub-ranges are intended to be inherently described in this specification such that amending to expressly recite any such sub-ranges would comply with the requirements of 35 U.S.C. §§ 112 and 132 (a).

The grammatical articles "one", "a", "an", and "the", as used in this specification, are intended to include "at least one" or "one or more", unless otherwise indicated. Thus, the grammatical articles are used in this specification to refer to one or more than one (i.e., to "at least one") of the grammatical objects of the article. By way of example only, "a component" means one or more components and, thus, possibly, more than one component is contemplated and may be employed or used in an implementation of the described embodiments. Further, the use of a singular noun includes the plural, and the use of a plural noun includes the singular, unless the context of the usage requires otherwise.

One skilled in the art will recognize that the herein described alloys and methods, and the discussion accompanying them, are used as examples for the sake of conceptual clarity and that various modifications are contemplated. Consequently, as used herein, the specific examples/embodiments set forth and the accompanying discussion are intended to be representative of their more general classes. In general, use of any specific exemplar is intended to be representative of its class and should not be taken as limiting. While the present disclosure provides descriptions of various specific embodiments for the purpose of illustrating various aspects of the present disclosure and/or its potential applications, it is understood that variations and modifications will occur to those skilled in the art. Accordingly, the invention or inventions described herein should be understood to be at least as broad as they are claimed and not as more narrowly defined by particular examples and illustrative embodiments provided herein.

What is claimed is:

1. A titanium alloy comprising, in weight percent based on total alloy weight:

3.65 to 4.5 aluminum;
1.5 to 2.3 tin;
1.5 to 2.5 zirconium;
2.0 to 4.25 molybdenum;
2.0 to 4.25 chromium;
0.01 to 0.03 silicon;
0 to 0.30 iron;
0 to 1.8 vanadium;
titanium; and
impurities;
wherein an aluminum equivalent value of the titanium alloy is 6.0 to 6.9 and a molybdenum equivalent value of the titanium alloy is 4.8 to 10.9;
wherein the titanium alloy exhibits a yield strength of at least 137 ksi, an ultimate tensile strength of at least 148 ksi, and a fracture toughness of at least 85 ksi√(in).

2. The titanium alloy of claim 1, wherein the molybdenum equivalent value of the titanium alloy is 7.0 to 10.9.

3. The titanium alloy of claim 1, wherein the aluminum equivalent value of the titanium alloy is 6.1 to 6.5.

4. The titanium alloy of claim 1 comprising, in weight percent based on total alloy weight:

3.65 to 4.5 aluminum;
1.5 to 2.3 tin;
1.5 to 2.5 zirconium;
2.0 to 4.25 molybdenum;
2.0 to 4.25 chromium;
0.01 to 0.03 silicon;
0 to 0.30 iron;
0 to 0.20 oxygen;
0 to 0.5 nitrogen;
0 to 0.0125 hydrogen;
0 to 0.08 carbon;
0 to 1.8 vanadium;
0 to less than 0.1 germanium;
0 to 0.1 of each of niobium, tungsten, hafnium, nickel, gallium, antimony, tantalum, manganese, cobalt, and copper;
titanium; and
impurities.

5. The titanium alloy of claim 1 comprising, in weight percent based on total alloy weight, 3.65 to 4.4 aluminum.

6. The titanium alloy of claim 1 comprising, in weight percent based on total alloy weight, 4.2 to 4.4 aluminum.

7. The titanium alloy of claim 1 comprising, in weight percent based on total alloy weight, 0.014 to 0.03 silicon.

8. The titanium alloy of claim 1 comprising, in weight percent based on total alloy weight, 0.02 to 0.03 silicon.

9. The titanium alloy of claim 1 comprising, in weight percent based on total alloy weight, 3.0 to 4.25 molybdenum and 3.0 to 4.25 chromium.

10. The titanium alloy of claim 1, wherein the titanium alloy exhibits a yield strength of at least 145 ksi, an ultimate tensile strength of at least 155 ksi, and a fracture toughness of at least 89 ksi√(in).

11. The titanium alloy of claim 1 comprising, in weight percent based on total alloy weight:

3.65 to 4.4 aluminum;
1.5 to 2.3 tin;
1.5 to 2.2 zirconium;
3.0 to 4.25 molybdenum;
3.0 to 4.25 chromium;
0.02 to 0.03 silicon;
0 to 0.30 iron;
0 to 0.20 oxygen;
0 to 0.5 nitrogen;
0 to 0.0125 hydrogen;
0 to 0.08 carbon;
0 to 1.8 vanadium;
0 to less than 0.1 germanium;
0 to 0.1 of each of niobium, tungsten, hafnium, nickel, gallium, antimony, tantalum, manganese, cobalt, and copper;
titanium; and
impurities.

12. The titanium alloy of claim 11, wherein a molybdenum equivalent value of the titanium alloy is 7.0 to 10.9.

13. The titanium alloy of claim 11, wherein an aluminum equivalent value of the titanium alloy is 6.1 to 6.5.

14. The titanium alloy of claim 11, wherein the titanium alloy exhibits a yield strength of at least 145 ksi, an ultimate tensile strength of at least 155 ksi, and a fracture toughness of at least 89 ksi√(in).

15. The titanium alloy of claim 1 comprising, in weight percent based on total alloy weight, 1.5 to 2.2 zirconium.

16. The titanium alloy of claim 1 comprising, in weight percent based on total alloy weight, 1.5 to 2.0 zirconium.

17. A method of making a titanium alloy, the method comprising:

solution treating the titanium alloy at 800° C. to 860° C. for 1 hour to 8 hours;
cooling the titanium alloy to ambient temperature;

aging the titanium alloy at 480° C. to 700° C. for 4 hours to 16 hours; and air cooling the titanium alloy;

wherein the titanium alloy has a composition as recited in claim 1.

18. An article of manufacture comprising the titanium alloy of claim 1.

19. The article of manufacture of claim 18, wherein the article of manufacture is selected from the group consisting of a foil, a sheet, a plate, a wire, a billet, a bar, a rod, a slab, an ingot, a forging, a casting, and a powder.

20. A titanium alloy comprising, in weight percent based on total alloy weight:

4.2 to 4.4 aluminum;
1.5 to 1.75 tin;
1.5 to 1.75 zirconium;
4.0 to 4.25 molybdenum;
4.0 to 4.25 chromium;
0.02 to 0.03 silicon;
0 to 0.30 iron;
0 to 0.20 oxygen;
0 to 0.5 nitrogen;
0 to 0.0125 hydrogen;
0 to 0.08 carbon;
1.0 to 1.8 vanadium;
0 to less than 0.1 germanium;
0 to 0.1 of each of niobium, tungsten, hafnium, nickel, gallium, antimony, tantalum, manganese, cobalt, and copper;
titanium; and
impurities;

wherein an aluminum equivalent value of the titanium alloy is 6.1 to 6.9 and a molybdenum equivalent value of the titanium alloy is 4.8 to 10.9;

wherein the titanium alloy exhibits a yield strength of at least 137 ksi, an ultimate tensile strength of at least 148 ksi, and a fracture toughness of at least 85 ksiv (in).

21. A titanium alloy comprising, in weight percent based on total alloy weight:

3.65 to 4.4 aluminum;
1.5 to 2.3 tin;
1.5 to 2.2 zirconium;
3.0 to 4.25 molybdenum;
3.0 to 4.25 chromium;
0.02 to 0.03 silicon;
0 to 0.30 iron;
0 to 0.20 oxygen;
0 to 0.5 nitrogen;
0 to 0.0125 hydrogen;
0 to 0.08 carbon;
0 to 1.8 vanadium;
0 to less than 0.1 germanium;
0 to 0.1 of each of niobium, tungsten, hafnium, nickel, gallium, antimony, tantalum, manganese, cobalt, and copper;
titanium; and
impurities;

wherein an aluminum equivalent value of the titanium alloy is 6.1 to 6.5 and a molybdenum equivalent value of the titanium alloy is 4.8 to 10.9; and wherein the titanium alloy exhibits a yield strength of at least 137 ksi, an ultimate tensile strength of at least 148 ksi, and a fracture toughness of at least 85 ksi√(in).

* * * * *